US005926684A

United States Patent [19]

Horiuchi et al.

[11] Patent Number: 5,926,684

[45] Date of Patent: Jul. 20, 1999

[54] IMAGE FORMING DEVICE HAVING POST-PROCESSING STATION ABOVE THE IMAGE FORMING STATION

[75] Inventors: Toshihiro Horiuchi, Nara; Toyoaki Nanba, Higashiosaka, both of Japan

[73] Assignee: Sharp Kabushiki Kaisha, Osaka, Japan

[21] Appl. No.: 08/984,074

[22] Filed: Dec. 3, 1997

[30] Foreign Application Priority Data

Dec. 18, 1996 [JP] Japan ..... 8-338157
Mar. 25, 1997 [JP] Japan ..... 9-071024

[51] Int. Cl.[6] ..... G03G 15/00

[52] U.S. Cl. ..... 399/402; 399/407

[58] Field of Search ..... 399/401, 402, 399/403, 407, 410, 107, 405; 271/287, 3.03, 301

[56] References Cited

U.S. PATENT DOCUMENTS

| | | | |
|---|---|---|---|
| 4,652,112 | 3/1987 | Randall | 399/402 |
| 4,990,965 | 2/1991 | Kiya | 399/402 |
| 5,011,130 | 4/1991 | Naito et al. . | |
| 5,166,738 | 11/1992 | Tani | 399/402 |
| 5,166,739 | 11/1992 | Katsuki et al. . | |
| 5,385,340 | 1/1995 | Hiroi et al. . | |
| 5,464,201 | 11/1995 | Deen et al. | 270/58.09 |
| 5,708,954 | 1/1998 | Ando et al. | 399/402 |
| 5,724,641 | 3/1998 | Shojo et al. | 399/410 |

FOREIGN PATENT DOCUMENTS

| | | |
|---|---|---|
| 548566A2 | 6/1993 | European Pat. Off. . |
| 610790A2 | 8/1994 | European Pat. Off. . |
| 694819A2 | 1/1996 | European Pat. Off. . |
| 59-82263 | 5/1984 | Japan . |
| 5286281 | 11/1993 | Japan . |
| 08006317 | 1/1996 | Japan . |

*Primary Examiner*—Robert Beatty

[57] ABSTRACT

An image-forming device according to the present invention has an image formation unit, a sheet postprocessing device made up of a postprocessing tray and at least a stapler, discharge rollers which discharge sheets of recording paper stacked in the postprocessing tray, and a discharge tray which receives the sheets discharged by the discharge rollers. The postprocessing tray is provided above the image formation unit, and the discharge tray is provided so that the surface on which the discharged sheets are stacked is lower than the postprocessing tray. With this structure, the image-forming device can be made compact in width, and operability, such as the ease of checking and removing the sheets stacked in the discharge tray, can be improved.

43 Claims, 12 Drawing Sheets

IMAGE FORMING DEVICE HAVING POST-PROCESSING STATION ABOVE THE IMAGE FORMING STATION

FIELD OF THE INVENTION

The present invention concerns an image-forming device to be used as a printer, facsimile, copy machine, etc., provided with a sheet postprocessing device which performs postprocessing such as stapling with respect to sheets such as transfer sheets on which images have been formed.

BACKGROUND OF THE INVENTION

In the past there have been conventional image-forming devices, such as printers, facsimiles, and copy machines, having sheet postprocessing devices which first stacked sheets such as transfer sheets with images formed thereon, and then performed postprocessing such as stapling, hole punching, and stamping.

Examples of this kind of image-forming device with sheet postprocessing device are disclosed in U.S. Pat. No. 5,385,340 (hereinafter "Document I") and in Japanese Unexamined Patent Publication Nos. 59-82263/1984 (hereinafter "Document II") and 5-286281/1993 (hereinafter "Document III").

For example, the image-forming device disclosed in Document I, as shown in FIG. 6, is composed of a sheet postprocessing unit 304 attached to the side of a main body 301 of the image-forming device.

In this image-forming device, an original placed on an original feed unit 303 is transported to and read by an optical unit 317, and a toner image is formed in an image formation unit 316 according to the Carlson process. A transfer sheet (hereinafter "sheet") is transported by a transport means 315 from any of sheet storage means 311, 312, 313, and 314 to the image formation unit 316. The toner image is transferred to the sheet and then fixed in a fixing unit 318, thereby forming the image on the sheet. The sheet with the image formed thereon is transported to a stapling tray 324 in the sheet postprocessing unit 304, stapled by a stapler 325, and discharged by a discharge means 320 into a discharge tray 323 attached to the exterior of the sheet postprocessing unit 304.

With this image-forming device, images may be formed on both the front and back of a sheet. When images are to be formed on both sides of a sheet, a sheet on the front side of which an image has been formed in the image formation unit 316 is turned over and stacked in an intermediate tray 319, and then transported back to the image formation unit 316, and after an image has been formed on the back of the sheet, it is transported to the sheet postprocessing unit 304.

As shown in FIG. 7, the image-forming device disclosed in Document II, like that in Document I, is composed of a sheet postprocessing unit 404 attached to the side of a main body 401 of the image-forming device.

In this image-forming device, an original placed on an original feed unit 403 is transported to and read by an optical unit 417, and a toner image is formed in an image formation unit 416 according to the Carlson process. A transfer sheet (hereinafter "sheet") is transported by a transport means 415 from a sheet storage means 411 to the image formation unit 416. The toner image is transferred to the sheet and then fixed in a fixing unit 418, thereby forming the image on the sheet. The sheet with the image formed thereon is transported to a stapling tray 424 in the sheet postprocessing unit 404, stapled by a stapler 425, and discharged through a turnover transport means 420 into a discharge tray 423.

In this image-forming device, when a stack of sheets which has undergone stapling, punching, or other postprocessing is discharged to the discharge tray 423, disarray of the stack is prevented by horizontal sliding and by allowing gravity to pull the stack down. Thus it is essential that the stack be discharged to the discharge tray 423.

In the image-forming device disclosed in Document III, as shown in FIG. 8, beneath an image formation unit 515 of the copy machine main body 501 is provided an intermediate tray 523 used for stacking sheets in double-sided copying. On the discharge side of the intermediate tray 523 is provided a filing device 535 having a stapler, which staples the stack of sheets stacked in the intermediate tray 523. In short, the intermediate tray 523 functions as the postprocessing tray of a sheet postprocessing device.

Accordingly, the image-forming device disclosed in Document III can be made more compact than conventional devices in which a sheet postprocessing unit was provided on the exterior of the copy machine main body.

However, in the device in Document I, as shown in FIG. 6, the sheet postprocessing unit 304 is provided on the side of the device, i.e., on the side of the main body, so that the stapling tray, discharge tray, etc. are provided on the side of the main body. Further, the hand-feed tray 314 is provided on the opposite side of the main body from the sheet postprocessing unit 304, so that the width of the hand-feed tray 314 and the width of the discharge tray 323 are added to the width of the main body. For this reason, the device in Document I has the disadvantage that the width of the device is increased, and the device as a whole is made larger.

In addition, during sheet postprocessing, the intermediate tray 319 (where the sheets with images formed thereon are stacked) and the stapling tray 324 (where the stack of sheets is stapled) are provided separately, thus wasting space and adding to costs.

In the case of the device in Document II, as shown in FIG. 7, since the discharge tray 423 is provided beneath the postprocessing tray 424, the postprocessing tray 424 is in the way, and the operator must bend down in order to check or remove the sheets discharged to the discharge tray 423. In other words, with the device in Document II, in order to view the sheets in the discharge tray 423, the user must look from the side of the device, and the discharged sheets are also difficult to remove. For these reasons, the device's operability is markedly impaired.

Again, with the device in Document III, as shown in FIG. 8, since the intermediate tray 523 used as a postprocessing tray is lower than the image formation unit 515, and the discharge tray 521 is provided even lower than the intermediate tray 523, the operator must bend down to remove the stack of sheets from the discharge tray 521, and such operation is troublesome, just as with the device in Document II.

Incidentally, among conventional image-forming devices such as copy machines and printers, some devices discharge a sheet of recording paper with an image formed thereon with the image side facing up, and other devices are provided with a turnover means (a means for turning over a sheet of recording paper) between the image formation unit and the discharge tray for discharging the sheet with the image side down. These devices can discharge the recording paper image side up by bypassing the turnover means, or discharge the recording paper image side down by transporting it through the turnover means.

However, the drawback of devices in which the turnover means is provided next to the image formation unit, and the discharge tray next to the turnover means, is that the width of the device as a whole is increased by the width of the turnover means.

In order to solve this problem, an image-forming device like that shown in FIG. 12 was proposed. In this image-forming device, a turnover means 682 is provided beneath the device main body 681, and a discharge tray 683 is provided on the side of the device main body 681. In this image-forming device, a sheet of recording paper with images formed thereon is discharged from a main body discharge hole 684 to a switching means 685. If the sheet is not to be turned over, the switching means 685 sends it to discharge rollers 686 and 687, which discharge it to the discharge tray 683.

If the sheet is to be turned over, on the other hand, the switching means 685 sends it to the turnover means 682 through a transport roller 688 and a pair of reversible rollers 689 and 690. While the rear end of the sheet in the turnover means 682 is held between the reversible rollers 689 and 690, the direction of rotation of the reversible rollers 689 and 690 is reversed. Thus the sheet is turned over by running it through a switchback. The sheet is then transported toward the discharge tray 683 by the discharge rollers 686 and 687, and discharged to the discharge tray 683.

However, in an image-forming device of this structure, each sheet must be transported into the turnover means until the rear end of the sheet clears the switching means, and then switched back and discharged to the discharge tray. Accordingly, when a number of sheets of recording paper are to be transported through the turnover means in succession, a sheet cannot be transported into the turnover means while the previous sheet is still in the turnover means, and the sheet transport interval must be equal to the time required for the switchback.

For this reason, when a number of sheets of recording paper are to have images formed on them in succession, the interval (time) between sheets required for switchback cannot be eliminated, and sheets with images formed thereon cannot be discharged at high speed, and thus efficiency of image formation cannot be improved.

SUMMARY OF THE INVENTION

The object of the present invention is to provide an image-forming device which is compact in width, and which is able to improve operability with regard to the visibility, removal, etc. of sheets in the discharge tray.

In order to achieve the foregoing object, one image-forming device of the present invention comprises:

(1) an image formation unit, which forms images on sheets of recording paper;

(2) a postprocessing device having a stacking section for stacking a plurality of sheets of recording paper on which images have been formed by the image formation unit, and a postprocessing section which performs postprocessing on the sheets stacked in the stacking section, this postprocessing device being provided above the image formation unit;

(3) a discharge device for discharging the sheets stacked in the stacking section; and (4) a discharge tray for receiving the sheets discharged by the discharge device.

With the above structure, the postprocessing device, which performs postprocessing such as stapling of the sheets stacked in the stacking section, is provided above the image formation unit. In other words, the postprocessing device is provided within the image-forming device itself. Therefore, in comparison with conventional devices with a postprocessing device attached to the outside of the image-forming device, the width of this image-forming device can be decreased by the width of the postprocessing device. By this means, the device can be made markedly more compact in width.

It is preferable to provide the discharge tray at substantially the same height as the stacking section. In this case, the postprocessed sheets will be discharged at a height at which they may be easily removed or checked by the operator. In other words, they will be discharged to a position in which they may be checked or removed by the operator in a normal operating posture, without having to bend down.

Another object of the present invention is to provide an image-forming device able to improve efficiency of image formation by high-speed, successive discharge of multiple sheets of recording paper with images formed thereon.

In order to achieve the foregoing object, another image-forming device of the present invention comprises:

(1) an image formation unit, which forms images on sheets of recording paper;

(2) a stacking section for stacking a plurality of sheets of recording paper on which images have been formed by the image formation unit, and a discharge tray to which are discharged sheets with images formed thereon;

(3) a first transport channel which turns the side of a sheet of recording paper with an image formed thereon to face upward or downward, and transports the sheet from the image formation unit to the stacking section;

(4) a second transport channel which transports a sheet of recording paper with the image side facing down from the image formation unit to the discharge tray;

(5) a switch for switching between the first and second transport channels;

(6) a third transport channel differing from the first and second transport channels, which transports sheets from the stacking section to the discharge tray; and (7) a discharge device which discharges a stack of sheets from the stacking section to the discharge tray through the third transport channel.

With the above structure, the discharge device discharges the sheets stacked in the stacking section through the third transport channel to the discharge tray. Accordingly, when sheets of recording paper with images formed thereon are to be turned over and discharged to the discharge tray, it is not necessary to turn over each sheet individually. For this reason, there is no need to delay transport of a sheet while the previous sheet is put through a switchback, and thus the time necessary for image formation operations, and in particular sheet discharge operations, can be reduced, and efficiency of image formation can be improved.

The other objects, features, and strengths of the present invention will be made clear by the description below. In addition, the advantages of the present invention will be evident from the following explanation in reference to the drawings.

DESCRIPTION OF THE EMBODIMENTS

Figure 1:
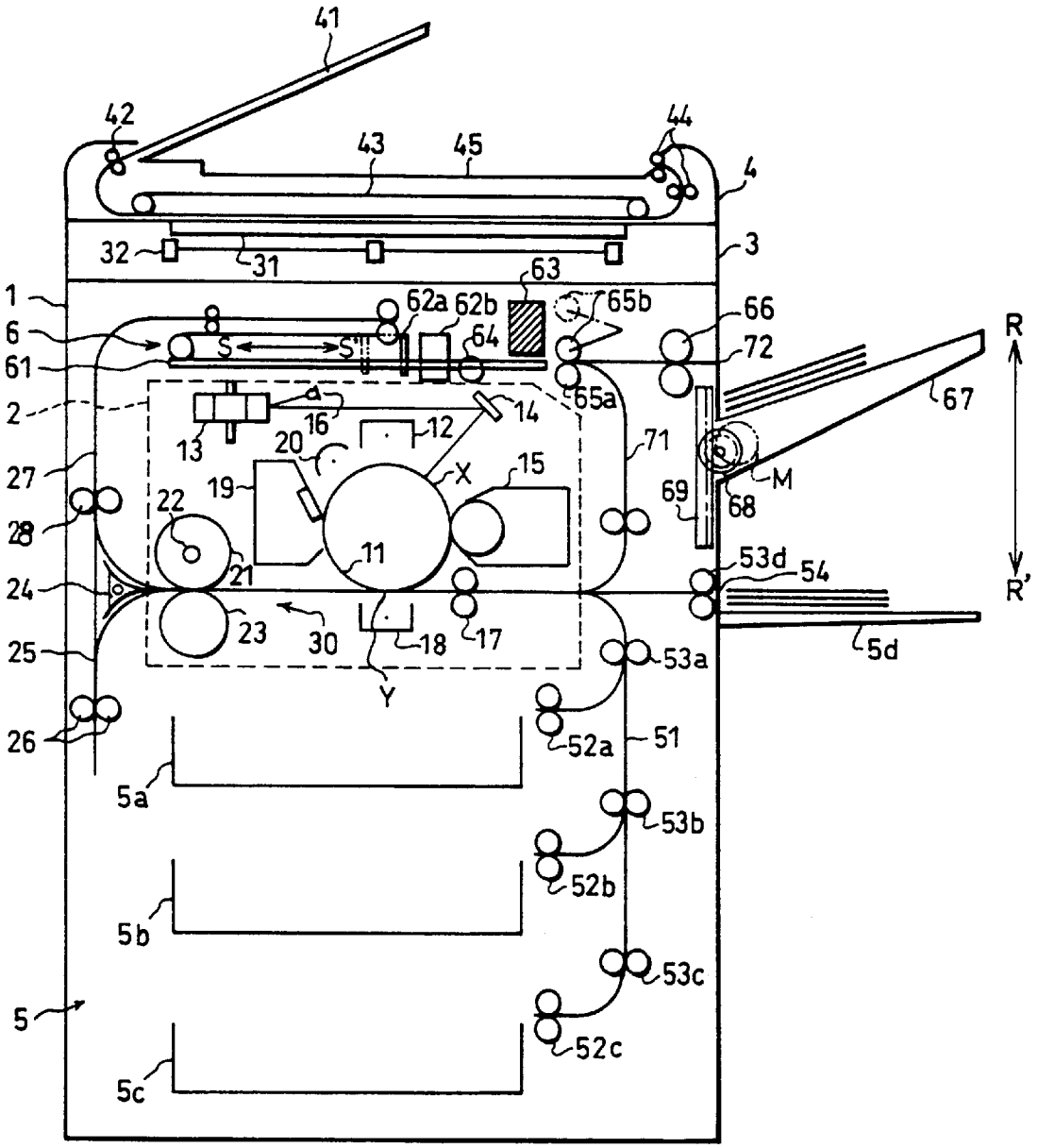
FIG. 1 is a schematic structural diagram of a copy machine which is an image-forming device with a sheet postprocessing device according to one embodiment of the present invention.
Figure 2:
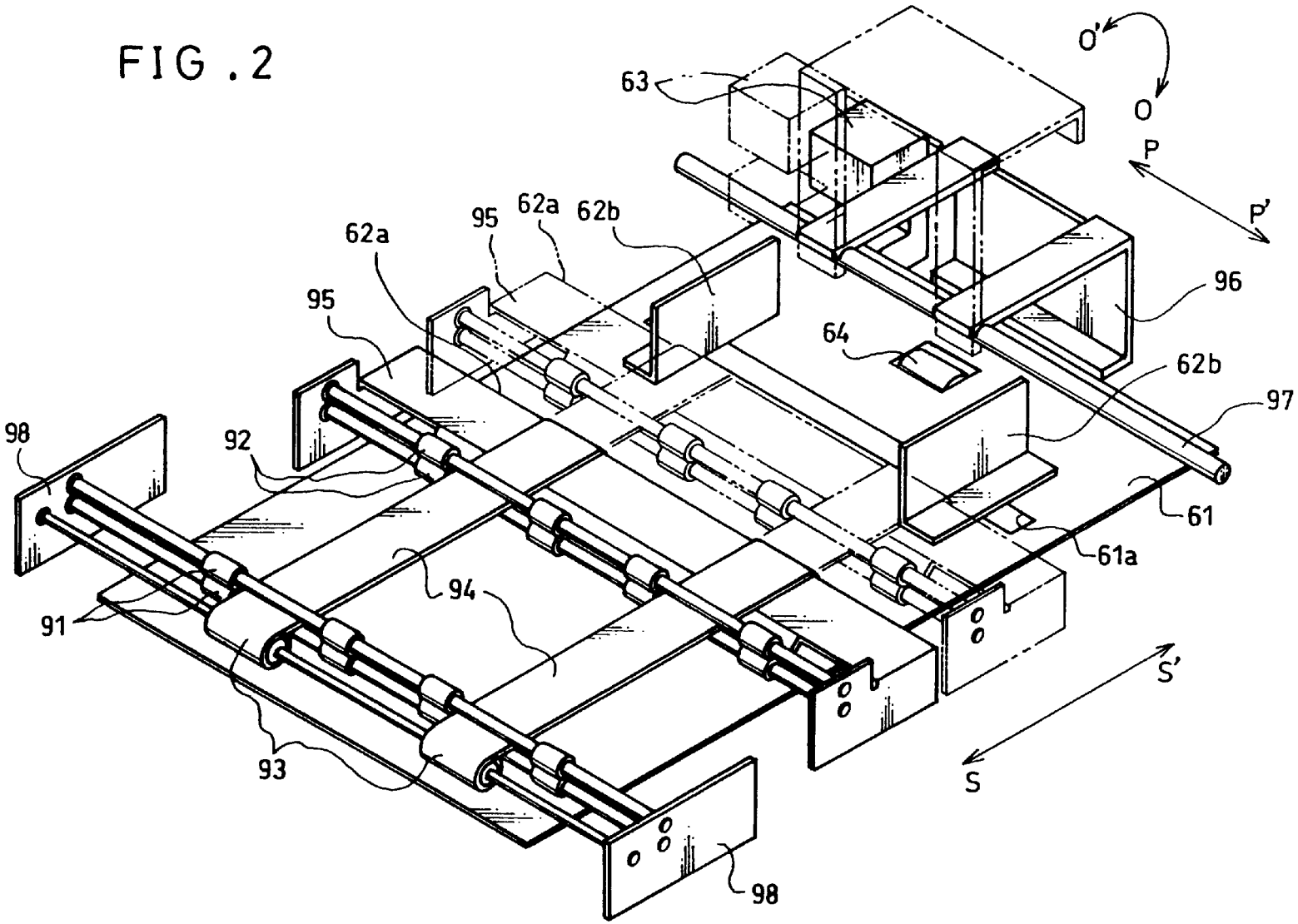
FIG. 2 is a schematic perspective view of the sheet postprocessing device of the copy machine shown in FIG. 1.
Figure 3:
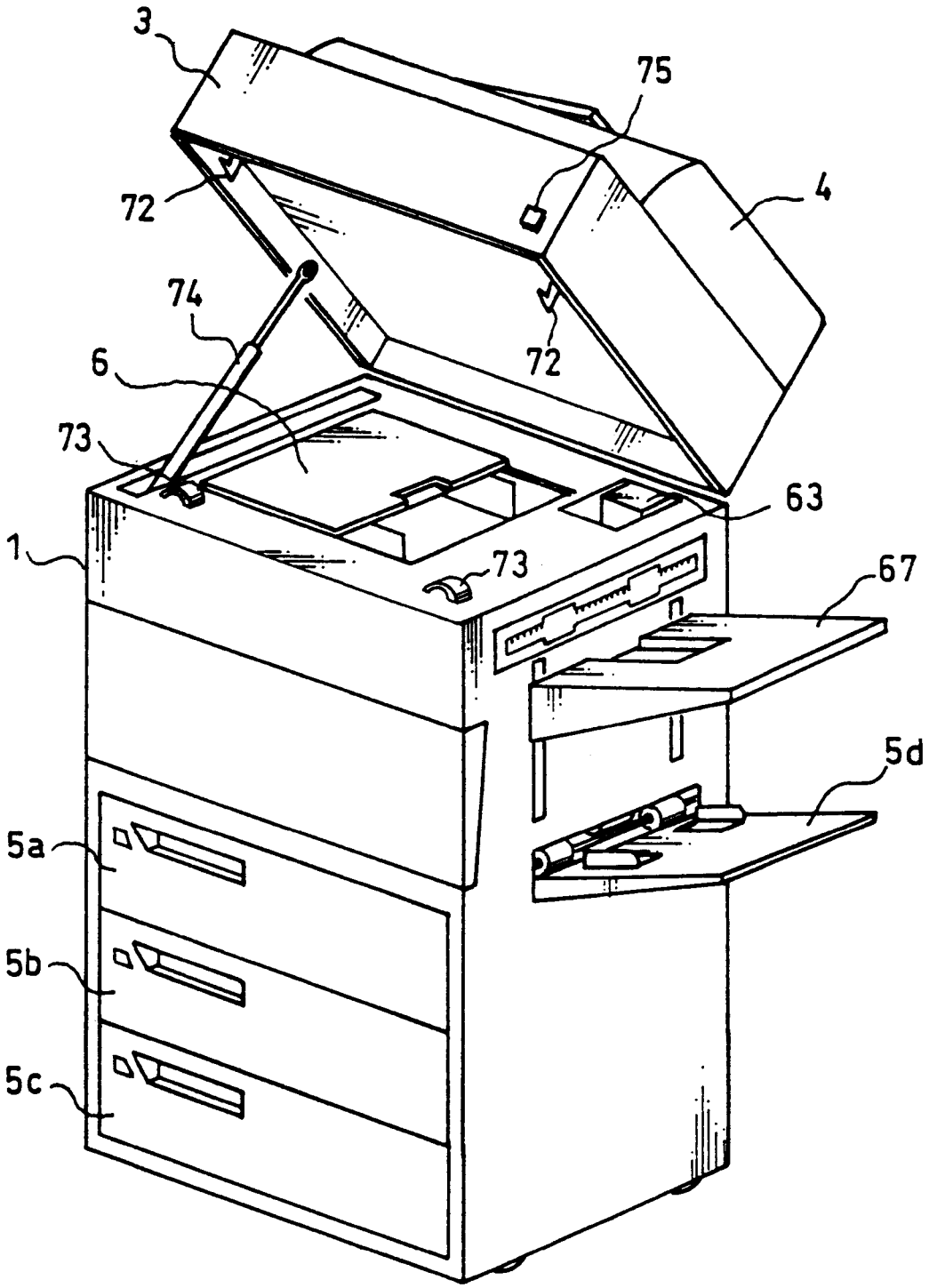
FIG. 3 is a perspective view showing the sheet postprocessing device of the copy machine shown in FIG. 1 in an exposed state.

The following will explain one embodiment of the present invention with reference to FIGS. 1 through 3. In the present embodiment, a combined copy machine functioning as a copy machine, printer, and facsimile will be explained.

The combined copy machine according to the present embodiment, as shown in FIG. 1, is provided with an exposure reading unit 3, an original feed unit 4, and a main body 1 made up of an image formation unit 2, a sheet storage unit 5, and a sheet postprocessing unit 6.

The image formation unit 2 forms images according to the Carlson process, and is provided roughly in the center of the main body 1. Roughly in the center of the image formation unit 2 is provided a photoreceptor 11, around which are provided a charging device 12, a developing device 15, a transfer device 18, a cleaning device 19, and a static eliminator 20. The image formation unit 2 is also provided with a pair of resist rollers 17 in the upstream transport direction from the photoreceptor 11, and a fixing device 30 downstream from the photoreceptor 11.

In accordance with a set timing, the resist rollers 17 transport sheets of recording paper to a transfer point Y, where the photoreceptor 11 and the transfer device 18 are opposite one another.

Within the fixing device 30, an upper heat roller 21 containing a heat lamp 22 puts pressure on and drives a lower heat roller 23. The toner image is fixed on the sheet at the place where the two heat rollers 21 and 23 press together.

Further, above the photoreceptor 11 are provided a polygon mirror 13, a mirror 14, and a laser oscillator element 16. Laser light emitted by the laser oscillator element 16 is projected onto the polygon mirror 13, which revolves at high speed, and is reflected by the mirror 14 onto the photoreceptor 11 at an exposure point X.

Image information (image data) is supplied to the laser oscillator element 16 by a memory device (not shown), and the laser oscillator element 16 controls the light beam projected onto the photoreceptor 11 on the basis of this image data. This image data may be, for example, image data read from an original placed on a glass plate 31 in the exposure reading unit 3 (when the combined copy machine is functioning as a copy machine), image data supplied by a personal computer (not shown) or other device (when the combined copy machine is functioning as a printer), or image data sent from telephone or other lines (when the combined copy machine is functioning as a facsimile).

Beneath the image formation unit 2 is provided the sheet storage unit 5. This sheet storage unit 5 has paper cassettes 5*a*, 5*b*, and 5*c*, which store sheets on which images are to be formed by the image formation unit 2. Sheets of different respective size are stored in each of the paper cassettes 5*a*, 5*b*, and 5*c*, and are selectively supplied to the image formation unit 2 by a supply transport channel 51.

In the supply transport channel 51 are provided (1) supply rollers 52*a*, 52*b*, and 52*c*, which supply one sheet at a time from the paper cassettes 5*a*, 5*b*, and 5*c*, respectively, and (2) transport rollers 53*a*, 53*b*, and 53*c* corresponding to the paper cassettes 5*a*, 5*b*, and 5*c*, respectively, for transporting to the image formation unit 2 the sheets supplied by the supply rollers 52*a*, 52*b*, and 52*c*, respectively.

In addition to the sheet storage unit 5, a hand-feed tray 5*d* (sheet supply means) is also provided upstream from the image formation unit 2 of the main body 1, for supplying from outside the device sheets on which images are to be formed. This hand-feed tray 5*d* is provided so that the surface of a sheet placed thereon is at substantially the same height as the transfer point Y of the image formation unit 2. Further, on the side of the main body 1 at the hand-feed tray 5*d* is provided a sheet intake hole 54, near which are provided a pair of transport rollers 53*d* for transporting one sheet at a time from the hand-feed tray 5*d* to the image formation unit 2.

In the downstream sheet transport direction from the image formation unit 2 of the main body 1 are provided a turnover gate 24, a turnover transport channel 25, and a postprocessing transport channel 27 for transporting sheets with images formed thereon to the sheet postprocessing unit 6.

In the postprocessing transport channel 27 is provided a pair of transport rollers 28 (transport means) for transporting sheets from the image formation unit 2 to the sheet postprocessing unit 6.

Accordingly, a sheet on which an image has been formed by the image formation unit 2 is transported, by means of the turnover gate 24, to either the turnover transport channel 25 or the postprocessing transport channel 27. A pair of reversible turnover rollers 26 is provided in the turnover transport channel 25. By reversing the direction of rotation of these turnover rollers 26 when a sheet is in the turnover transport channel 25, the sheet held between the turnover rollers is switched back and transported into the postprocessing transport channel 27, where the transport rollers 28 transport the sheet into the sheet postprocessing unit 6. Thus the turnover gate 24, the turnover transport channel 25, and the turnover rollers 26 make up a turnover means.

The sheet postprocessing unit 6 is provided above the image formation unit 2, and performs postprocessing such as stapling with respect to the sheets transported from the postprocessing transport channel 27.

The sheet postprocessing unit 6 is composed of a postprocessing tray 61, a rear-end plate 62*a* (alignment and discharge member), two alignment plates 62*b*, a stapler 63, a transport roller 64 (discharge means), a resupply roller 65*a*, and a separation roller 65*b*.

The postprocessing tray 61 is a stacking section where the sheets transported from the postprocessing transport channel 27 are stacked temporarily. The rear-end plate 62*a* is provided so as to be moveable along the postprocessing tray 61 in the S–S' direction, and serves to move the sheets stacked in the postprocessing tray 61 in the S' direction, i.e., to push the sheets in the downstream direction. The alignment plates 62*b* are provided for aligning the sheets stacked in the postprocessing tray 61 along their width (perpendicular to the downstream direction). Thus, the sheets stacked in the postprocessing tray 61 are aligned with each other along their length and width by the rear-end plate 62*a* and the alignment plates 62*b*.

The stapler 63 is provided at the downstream end of the postprocessing tray 61, and staples the sheets stacked therein.

The transport roller 64 is provided in the postprocessing tray upstream from the stapler 63. Sheets pushed in the S' direction by the rear-end plate 62*a* are transported between the separation roller 65*b*and the resupply roller 65*a* by the transport roller 64.

The separation roller 65*b* is separable from the resupply roller 65*a*, i.e., it can be moved from a position touching the resupply roller 65*a* to a position separated from it (the position indicated on the Figure by two-dot and dash lines). When a stack of stapled sheets is to be discharged, the separation roller 65*b* is moved away to the position indicated by the two-dot and dash lines, thus separating it from the resupply roller 65*a*, but when an image is to be formed on the back of a sheet, the separation roller 65*b* touches the resupply roller 65*a*.

Downstream from the resupply roller 65*a*, and at substantially the same height, are provided a pair of discharge rollers 66, which are sponge rollers, and a discharge hole 72, from which the discharge rollers 66 discharge the sheets. Near the discharge hole 72 is provided a discharge tray 67 to receive the sheets discharged from the discharge hole 72. The details of the discharge tray 67 will be discussed below.

Downstream from the resupply roller 65*a*, but in a position differing from that of the discharge rollers 66, is provided a resupply transport channel 71, which transports the sheets from the resupply roller 65*a* to the image formation unit 2.

Therefore, depending on whether the separation roller 65*b* is touching the resupply roller 56 or is separated from it, a sheet transported past the resupply roller 65*a* is transported either to the discharge rollers 66 or to the resupply transport channel 71.

In other words, when the operator has indicated, by means of an operating panel (not shown), that stapling is to be performed, and sheets transported through the postprocessing transport channel 27 have passed through the turnover transport channel 25, the sheet postprocessing unit 6 stacks the sheets face-up in the postprocessing tray 61, from the bottom up. After stacking, the sheets in the postprocessing tray 61 are pushed in the S' direction by the rear-end plate 62*a*, and are aligned by the alignment plates 62*b*.

After the sheets are aligned in this way, since the operator has indicated, by means of the operating panel, that stapling is to be performed, the stack of sheets is stapled by the stapler 63.

Next, the details of the sheet postprocessing unit 6 will be explained with reference to FIGS. 1 and 2. For convenience, the sheet discharge end of the postprocessing tray 61 (toward the discharge tray 67) will be referred to as the front end, and the sheet carry-in end (toward the postprocessing transport channel 27) will be referred to as the rear end.

As shown in FIG. 2, the sheet postprocessing unit 6 is provided with a plurality of pairs of transport rollers 91 (hereafter referred to simply as "transport rollers 91") and with a rear-end guide unit 95.

The transport rollers 91 are provided at regular intervals along two shafts, the ends of which are supported by two support plates 98, provided vertically in the main body 1 parallel to the discharge direction of the postprocessing tray 61.

The rear-end plate 62*a* is provided at the front end of the rear-end guide unit 95, which is moveable in the S–S' direction by a movement mechanism (not shown). In other words, the rear-end guide unit 95 can be moved from the position indicated on FIG. 2 by solid lines to that indicated by two-dot and dash lines, and vice versa.

In the rear-end guide unit 95 are provided pairs of postprocessing tray discharge rollers 92, which transport sheets from the transport rollers 91 to the postprocessing tray 61. The postprocessing tray discharge rollers 92 are provided at regular intervals along two shafts, the ends of which are supported by the two ends of the rear-end guide unit 95.

Between the transport rollers 91 and the postprocessing tray discharge rollers 92 are provided guide films 94, which act as a guide means to guide sheets from the postprocessing transport channel 27 to the postprocessing tray 61.

One end of each guide film 94 passes through an interval between pairs of the postprocessing tray discharge rollers 92 and is fixed to the rear-end guide unit 95, and the other end passes through an interval between pairs of the transport rollers 91 and is wrapped on one of two wrapping rollers 93, which are provided at regular intervals on a shaft, each end of which is supported by the support plates 98 provided in the main body 1. In other words, when the rear-end guide unit 95 moves in the S' direction, the wrapping rollers 93 rotate in the unwrap direction, and the guide films 94 are unrolled, and when the rear-end guide unit 95 moves in the S direction, the wrapping rollers 93 rotate in the wrap direction, and the guide films 94 are rolled up, thus keeping the guide films constantly stretched tight.

A rectangular guide groove 61*a* is provided in the postprocessing tray 61 perpendicular to the sheet transport direction (in the P–P' direction), and the two alignment plates 62*b* are provided so as to be moveable along the guide groove 61*a*.

Between the guide groove 61*a* and the front end of the postprocessing tray 61 are provided the transport roller 64 and the stapler 63, and at the front end of the postprocessing tray 61 is provided a front-end stopper 96, against which are pushed the front ends of sheets transported into the postprocessing tray 61, and which aligns the front ends of those sheets.

By means of a driving device (not shown), the front-end stopper 96 turns vertically on a front-end stopper rotation axis 97, which is provided above the front end of the postprocessing tray 61, in the O–O' direction, i.e., from the operating position shown on the figure by solid lines to the withdrawn position shown on the Figure by two-dot and dash lines, and vice versa.

By means of another driving device (not shown), the stapler 63 is also moveable in accordance with the size of the sheets in the P–P' direction along the front end of the postprocessing tray 61, from the operating position shown on the Figure by solid lines to the waiting position shown on the Figure by two-dot and dash lines, and vice versa. The stapler 63 is usually in the waiting position shown by the two-dot and dash lines, but during stapling moves in the P' direction in accordance with the size of the sheets transported into the postprocessing tray 61.

Next the operations of the sheet postprocessing unit 6 will be explained.

First, when sheets are to be transported into the postprocessing tray 61, the rear-end guide unit 95 is moved in the S direction, where it waits. Then, when sheets have been transported into the postprocessing tray 61, the rear-end guide unit 95 moves in the S' direction, pushing the rear ends of the stacked sheets in the S' direction with the rear-end plate 62*a* until the front ends of the stacked sheets are pushed against and aligned by the front-end stopper 96, which is in its operating position. At the same time, the alignment plates 62*b* move along the guide groove 61*a*, aligning the stacked sheets along their width.

After the stacked sheets are aligned in this way, if the user has indicated by means of the operating panel (not shown) that stapling is to be performed, the front-end stopper 96 is raised to its withdrawn position, and the stapler 63 moves from its waiting position to its operating position, and the sheets stacked in the postprocessing tray 61 are stapled.

Then the transport roller 64 transports the stapled stack of sheets in the S' direction, and the resupply roller 65*a* transports it to the discharge tray 67.

The discharge tray 67 is, as shown in FIG. 1, provided at substantially the same height as the postprocessing tray 61. Further, it is preferable if the discharge tray 67 is provided above the hand-feed tray 5*d*, and on the side of the main body 1.

The discharge tray 67 is provided with a stepping motor M as an elevating means, and an elevating gear 68 driven by this stepping motor M. On the side of the main body 1 opposite the discharge tray 67, a rack 69 which meshes with the elevating gear 68 is provided in the vertical direction (the R–R' direction shown in the Figure).

The stepping motor M raises or lowers the discharge tray 67 as needed. In concrete terms, the discharge tray is raised or lowered in accordance with the amount of sheets stacked in the discharge tray 67. In this case, the amount of sheets in the discharge tray 67 is detected by a sensor means (not shown) which detects the height of the uppermost sheet in the discharge tray 67. Operation of the stepping motor M is controlled by the sensor signal, and the discharge tray 67 is raised or lowered as needed. The surface of the uppermost sheet in the discharge tray 67 may be detected by a commonly-known sensor body (sensor arm) which detects the upper surface of recording paper. Alternatively, the height of the uppermost sheet in the discharge tray 67 may also be detected by an optical sensor means including a light-emitting element and a photosensitive element, or by a mechanical sensor means including a limit switch.

If the discharge tray 67 is raised and lowered in this way in accordance with the amount of sheets stacked therein, the upper surface of the stack can be maintained at a constant height. Thus, since the last sheet discharged can be kept at approximately the same height as the postprocessing tray 61, stable discharge of sheets to the discharge tray can be maintained, and visual checking of the discharged sheets by the operator is also simplified.

As is evident from the above, in a copy machine with the foregoing structure, the image formation unit 2 and the postprocessing tray 61 of the sheet postprocessing unit 6 are provided in a stacked (vertical) arrangement, thus providing a copy machine compact in width, and allowing definite space savings.

Further, since the hand-feed tray 5*d* is provided beneath the discharge tray 67, there is nothing obstructing above the discharge tray 67, and the operator can thus visually check discharged sheets while standing at the side of the main body 1. Removal of the discharged sheets is also made easy.

In addition, since the postprocessing tray 61 serves both as an intermediate tray for temporary stacking of sheets with images formed on one side in double-sided copying, and as a postprocessing tray where the postprocessing such as stapling is performed, there is no need to provide two separate trays, thus eliminating waste and allowing simplification of the structure of the device.

Above the image-forming device main body 1, i.e., above the sheet postprocessing unit 6, is provided, as shown in FIG. 1, the exposure reading unit 3, and above the exposure reading unit 3 is provided the original feed unit 4.

The exposure reading unit 3 is provided with a glass plate 31 where the original is positioned for copying, and a CCD sensor 32 which is capable of moving back and forth under the original positioned on the glass plate 31. The exposure reading unit 3 reads the image on the original by scanning with the CCD sensor 32 based on an exposure start signal. This exposure start signal is produced when the print button on the operating panel (not shown) is pushed.

The original feed unit 4 is provided with an original supply tray 41 where a stack of originals is placed, a pair of original supply rollers 42 which transport the originals one page at a time toward the glass plate 31, an original transport belt 43 which transports an original sheet to the glass plate 31 and positions it at a certain exposure position, an original discharge tray 45 where the originals which have been read are stacked, and two pairs of original discharge rollers 44 which discharge to the original discharge tray 45 the originals which have been read.

As shown in FIG. 3, the exposure reading unit 3 and the original feed unit 4 can be integrally opened in order to expose the sheet postprocessing unit 6 of the main body 1. In other words, the exposure reading unit 3 and the original feed unit 4 turn together vertically on a supporting axle on the side of the main body 1 away from the operator, opening to expose the sheet postprocessing unit 6 of the main body 1.

The exposure reading unit 3 opens upward from the main body 1 by the force of a gas spring 74. An unlock button 75 is provided on the front of the exposure reading unit 3, i.e., on the side where the operator stands, and on the right and left sides of the inside front of the exposure reading unit 3 are provided locking hooks 72, which turn inward when the unlock button is pressed toward the exposure reading unit 3. Further, on the right and left sides of the upper surface of the main body 1 are provided locking members 73, on which the locking hooks 72 catch, thus holding the exposure reading unit 3 and the main body 1 closed against the force of the gas spring 74.

In other words, when the unlock button 75 is pushed, the locking hooks 72 no longer catch on the locking members 73, and the exposure reading unit 3 opens upward by the force of the gas spring 74, thus exposing the sheet postprocessing unit 6.

With the above structure, in case of a paper jam, the exposure reading unit 3 can be opened and the sheet postprocessing unit 6 exposed merely by pushing the unlock button 75. As a result, the sheet postprocessing unit 6 can be easily removed from the main body 1, and paper jams in the sheet postprocessing unit 6 can also be handled easily.

In addition, since the sheet postprocessing unit 6 can be easily exposed, not only can the sheet postprocessing unit 6 be easily removed, but refilling of the stapler 63 and cleaning and maintenance of the other parts of the sheet postprocessing unit 6 are also made easy.

In an image-forming device with the foregoing structure, when exposing the sheet postprocessing unit 6, the exposure reading unit 3 and the original feed unit 4 integrally open upward, but there is no need to be limited to this structure. For example, a structure in which the exposure reading unit 3 slides on the main body 1 to expose the sheet postprocessing unit 6 is also possible. In this case, it is preferable to use a structure in which the exposure reading unit 6 slides open in the direction of the discharge tray 67 and the hand-feed tray 5*d*. Thus there is no need to allow extra space for sliding open the exposure reading unit 3, and the space where the image-forming device is installed can be used effectively.

In an image-forming device with the foregoing structure, the possible image formation modes include face-up discharge mode, face-down discharge mode, double-sided copying mode, etc. The following will explain each of these image formation modes.

First, the face-up discharge mode will be explained. This mode is usually used when the image-forming device is used as a copy machine, when forming images by opening the original feed unit 4 upward and placing an original on the glass plate 31.

First, paper size, paper type, image density (dark/light), magnification, etc. are set on the operating panel (not shown). Then, when the print button on the operating panel is pressed, reading of the original on the glass plate 31 begins. The image of the original is read by the CCD sensor 32, and the image data thus read are stored in a memory device (not shown) made of a high-capacity flash memory. Next, image processing is performed in accordance with the image density, magnification, etc. set through the operating panel. Then the laser oscillator element 16 projects light on and exposes the point X on the photoreceptor 11, thus forming an image.

Any type of memory device capable of storing the image data as electronic signals may be used, such as RAM, a hard disk, a magnetic memory medium, a magneto-optical memory medium, etc.

In accordance with the paper size and paper type set through the operating panel, one of the paper cassettes 5*a*, 5*b*, and 5*c*, or the hand-feed tray 5*d* is selected. A sheet is transported from the cassette or tray selected to the image formation unit 2, where the toner image formed in the image formation unit 2 is transferred onto the sheet. The sheet onto which the toner image has been transferred is then transported to the fixing device 30, where the toner image is fixed on the sheet.

Next, the sheet with the image formed thereon is transported into the turnover transport channel 25 by the turnover gate 24, and is held between and transported downward by the reversible turnover rollers 26. Then the turnover gate 24 is switched over, the turnover rollers 26 reverse their direction of rotation, and the sheet held between them is transported through the postprocessing transport channel 27 to the postprocessing tray 61 of the sheet postprocessing unit 6.

Now, if multiple copies have been set through the operating panel, that many copies will be stacked in the postprocessing tray 61 and then discharged to the discharge tray 67. In this case, the sheets are stacked in the postprocessing tray 61 with the image side facing up.

Next, the face-down discharge mode will be explained. This mode is usually used when the image-forming device is used as a printer or facsimile, when copying using the original feed unit 4, etc.

First, when the image-forming device is being used as a printer, if the image data from an image-forming device (not shown) extends over several pages, the image data is generally sent beginning with the first page and ending with the last page. Accordingly, when the image-forming device receives this type of multi-page image data, it is stored in page order in the memory device of the main body 1, and images are formed in page order.

At this time, according to the paper size and paper type set through the operating panel, a sheet from one of the paper cassettes 5*a*, 5*b*, and 5*c*, or the hand-feed tray 5*d* is transported to the image formation unit 2, where the toner image formed in the image formation unit 2 is transferred to the sheet. The sheet onto which the toner image has been transferred is then transported to the fixing device 30, where the toner image is fixed on the sheet.

Next, the sheet on which an image has been formed by the image formation unit 2 is transported by the turnover gate 24 through the postprocessing transport channel 27 into the postprocessing tray 61 of the sheet postprocessing unit 6. Then, after all the sheets through the last page have been stacked in the postprocessing tray 61, they are discharged to the discharge tray 67.

In this case, the sheets discharged to the discharge tray 67 are stacked with the image side facing down, but since they are stacked in the page order of the image data from the image-forming device, the sheets are stacked in the correct order. In other words, the sheets in the discharge tray 67 are stacked from the bottom up, from page one through the last page.

In case multiple copies are to be made, each complete multi-page copy is stacked in the postprocessing tray 61 and discharged separately, so that each multi-page copy is stacked face-down in the discharge tray 67.

Use of the image-forming device as a facsimile is the same as the use as a printer described above.

Next, when copying is to be performed using the original feed unit 4, first, using the operating panel, paper size, paper type, image density, magnification, etc. are set. Then, when the print button on the operating panel is pressed, the originals are transported one page at a time, from page one through the last page, from the original supply tray 41 to the glass plate 31, the image of the original on the glass plate 31 is read by the CCD sensor 32, and the image data thus read are stored in the memory device made of a high-capacity flash memory. Next, image processing of each page in order is performed in accordance with the image density, magnification, etc. set through the operating panel, and the light from the laser oscillator element 16 is projected on and exposes the point X on the photoreceptor 11, thus forming an image.

At this time, according to the paper size and paper type set through the operating panel, a sheet from one of the paper cassettes 5*a*, 5*b*, and 5*c*, or the hand-feed tray 5*d* is transported to the image formation unit 2, where the toner image formed therein is transferred to the sheet. The sheet onto which the toner image has been transferred is then transported to the fixing device 30, where the toner image is fixed on the sheet.

Next, each sheet on which an image has been formed by the image formation unit 2 is transported in page order by the turnover gate 24 through the postprocessing transport channel 27 into the postprocessing tray 61 of the sheet postprocessing unit 6. After all the sheets through the last page have been stacked face-down in the postprocessing tray 61, in page order beginning with page one, if the operator has indicated that stapling is to be performed, the sheets are stapled and then discharged to the discharge tray 67.

In case multiple copies are to be made, each complete multi-page copy is stacked in the postprocessing tray 61 and discharged separately, so that each multi-page copy is stacked face-down in the discharge tray 67.

Next, the double-sided copying mode will be explained. This mode can be used when placing an original directly on the glass plate 31, when using the image-forming device as a printer or facsimile, and when copying using the original feed unit 4.

First, when the print button on the operating panel is pushed, images corresponding to the odd-numbered pages of the original, beginning with the last odd-numbered page and ending with page one, are formed on sheets of recording paper. Each sheet on which an image has been formed is transported into the turnover transport channel 25 by the turnover gate 24, turned over, and transported into the postprocessing tray 61.

The sheets transported into the postprocessing tray 61 are aligned by the rear-end plate 62*a* and the alignment plates 62*b*, and are then transported into the resupply transport channel 71 by the transport roller 64, beginning with the sheet on the bottom of the postprocessing tray 61.

Next, images corresponding to the even-numbered pages of the original, beginning with the last even-numbered page and ending with page two, are formed on the reverse side of the sheets of recording paper. The sheets with images formed on both sides are then transported by the turnover gate 24 through the postprocessing transport channel 27 and into the postprocessing tray 61. Then, when one complete multi-page copy has been stacked in the postprocessing tray 61, if the operator has indicated that stapling is to be performed, the stack is stapled, and then discharged to the discharge tray 67.

In this case, the multi-page copy is discharged to the discharge tray 67 with the front of page one facing up.

Next, another embodiment of the present invention will be explained with reference to FIG. 4. For ease of explanation, members having the same function as those of the foregoing embodiment will be given the same reference symbols, and explanation thereof will be omitted.

Figure 4:
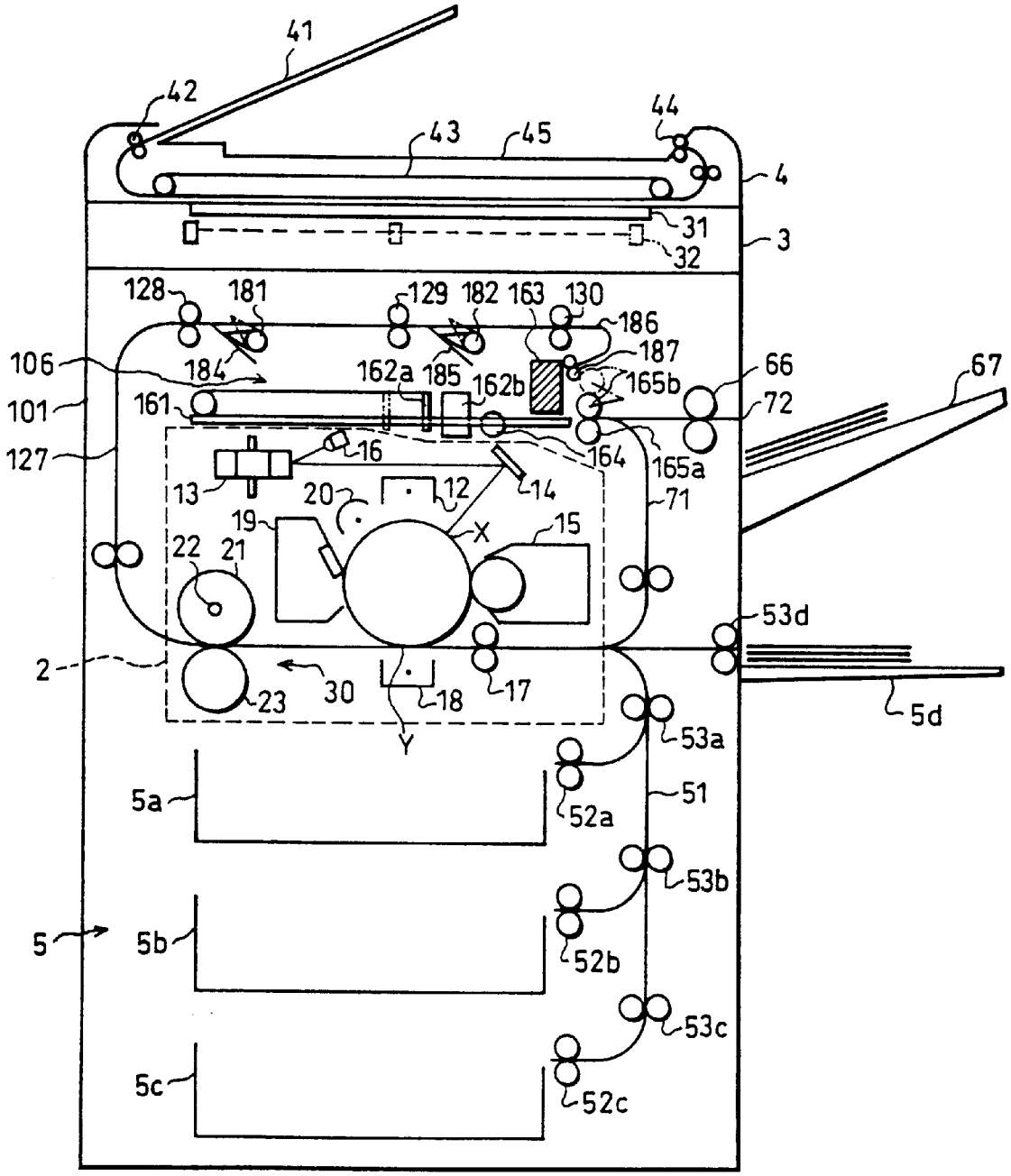
FIG. 4 is a schematic structural diagram of a copy machine which is an image-forming device with a sheet postprocessing device according to another embodiment of the present invention.

As shown in FIG. 4, the copy machine in the present embodiment has a sheet postprocessing unit 106 in place of the sheet postprocessing unit 6 of the copy machine shown in FIG. 1, and also has a main body 101 provided with a postprocessing transport channel 127, which transports sheets from the fixing device 30 of the image formation unit 2 to the sheet postprocessing unit 106. This postprocessing transport channel 127 is not provided with the turnover gate 24, the turnover transport channel 25, and the turnover rollers 26 which make up the turnover means for turning over sheets in the copy machine in the foregoing embodiment. The turning over of sheets performed by those members in the copy machine in the foregoing embodiment is, in the present embodiment, performed in the sheet postprocessing unit 106. Sheet turnover will be made clear in the explanation of the sheet postprocessing unit 106 below.

The sheet postprocessing unit 106 comprises a postprocessing tray 161, a rear-end plate 162*a* (alignment and discharge means), alignment plates 162*b*, a stapler 163, a transport roller 164, a resupply roller 165*a*, and a separation roller 165*b*. These members are the same as the corresponding postprocessing tray 61, rear-end plate 62*a*, alignment plates 62*b*, stapler 63, transport roller 64, resupply roller 65*a*, and separation roller 65*b* of the foregoing embodiment, and accordingly explanation thereof will be omitted.

The postprocessing transport channel 127 is a transport means which guides sheets from the image formation unit 2 to the postprocessing tray 161, which is a sheet stacking section.

In the portion of the postprocessing transport channel 127 above the postprocessing tray 161 are provided a large-size sheet intake hole 184 (first sheet intake hole), a small-size sheet intake hole 185 (second sheet intake hole) downstream from the large-size sheet intake hole 184, and a turnover transport channel 186 downstream from the small-size sheet intake hole 185.

In the postprocessing transport channel 127 near the large-size sheet intake hole 184 are provided a large-size sheet gate 181 and a pair of transport rollers 128.

When a sheet with an image formed thereon is of A3 size or other large size, and is to be introduced by the transport rollers 128 into the postprocessing tray 161 face-down, the large-size sheet gate 181 turns to the position indicated on the Figure by two-dot and dash lines, thus guiding the large sheet through the large-size sheet intake hole 184.

At other times, the large-size sheet gate 181 is in the position indicated on the Figure by solid lines. In this case, a sheet transported by the transport rollers 128 is guided to succeeding transport rollers 129 mentioned below.

In the postprocessing transport channel 127 near the small-size sheet intake hole 185 are provided a small-size sheet gate 182 and a pair of transport rollers 129.

When a sheet with an image formed thereon is of A4 or B5 size or other small size, and is to be introduced by the transport rollers 129 into the postprocessing tray 161 face-down, the small-size sheet gate 182 turns to the position indicate d on the Figure by two-dot and dash lines, thus guiding the small sheet through the small-size sheet intake hole 185.

At other times, the small-size sheet gate 182 is in the position indicated on the Figure by solid lines. In this case, a sheet transported by the transport rollers 129 is guided to succeeding transport rollers 130 mentioned below.

A sheet is guided into the turnover transport channel 186 when neither the large-size sheet gate 181 nor the small-size sheet gate 182 operates, i.e., when a sheet, of whatever size, is to be introduced into the postprocessing tray 161 face-up. In this case, a pair of transport rollers 187 provided at the end of the turnover transport channel 186 guide the sheet transported from the transport rollers 130 into the postprocessing tray 161.

After a stack of sheets with images formed thereon has been introduced into the postprocessing tray by any of the three routes mentioned above, the sheets are aligned, and if the operator has indicated that stapling is to be performed, the stack is stapled by the stapler 163, and discharged to the discharge tray 67.

In the above structure, in the postprocessing transport channel 127, large-size sheets are introduced through the large-size sheet intake hole 184, and sheets smaller than the sheets introduced through the large-size sheet intake hole 184 are introduced through the small-size sheet intake hole 185. For this reason, in comparison with a structure in which all sheets are introduced into the postprocessing tray 161 (which is a sheet stacking section) through a single hole, the sheets in the postprocessing tray can be easily aligned.

Further, as a turnover means, the above structure provides the turnover transport channel 186 and the transport rollers 187. By the turnover means a sheet transported from the transport rollers 130 is turned over and introduced into the postprocessing tray 161. Thus, there is no need to provide a turnover means next to the image formation unit 2, as was done in the copy machine in the first embodiment (shown in FIG. 1), and the width of the device as a whole can be reduced.

As a discharge means, the first embodiment provided the rear-end plate 62*a*, the transport roller 64, and the resupply roller 65*a*, but there is no need to be limited to this. For example, a discharge means structured as shown in FIG. 5 may also be used.

Figure 5:
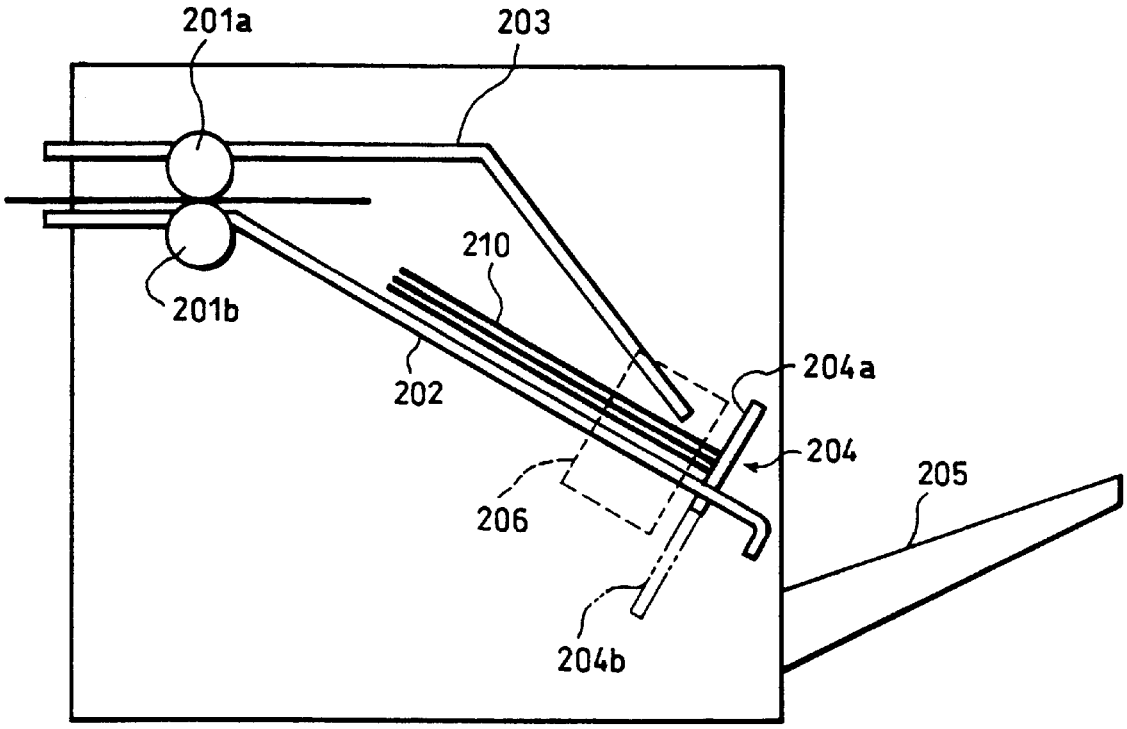
FIG. 5 is an explanatory diagram showing an example of an alternate discharge structure for an image-forming device with a sheet postprocessing device according to the present invention.
Figure 6:
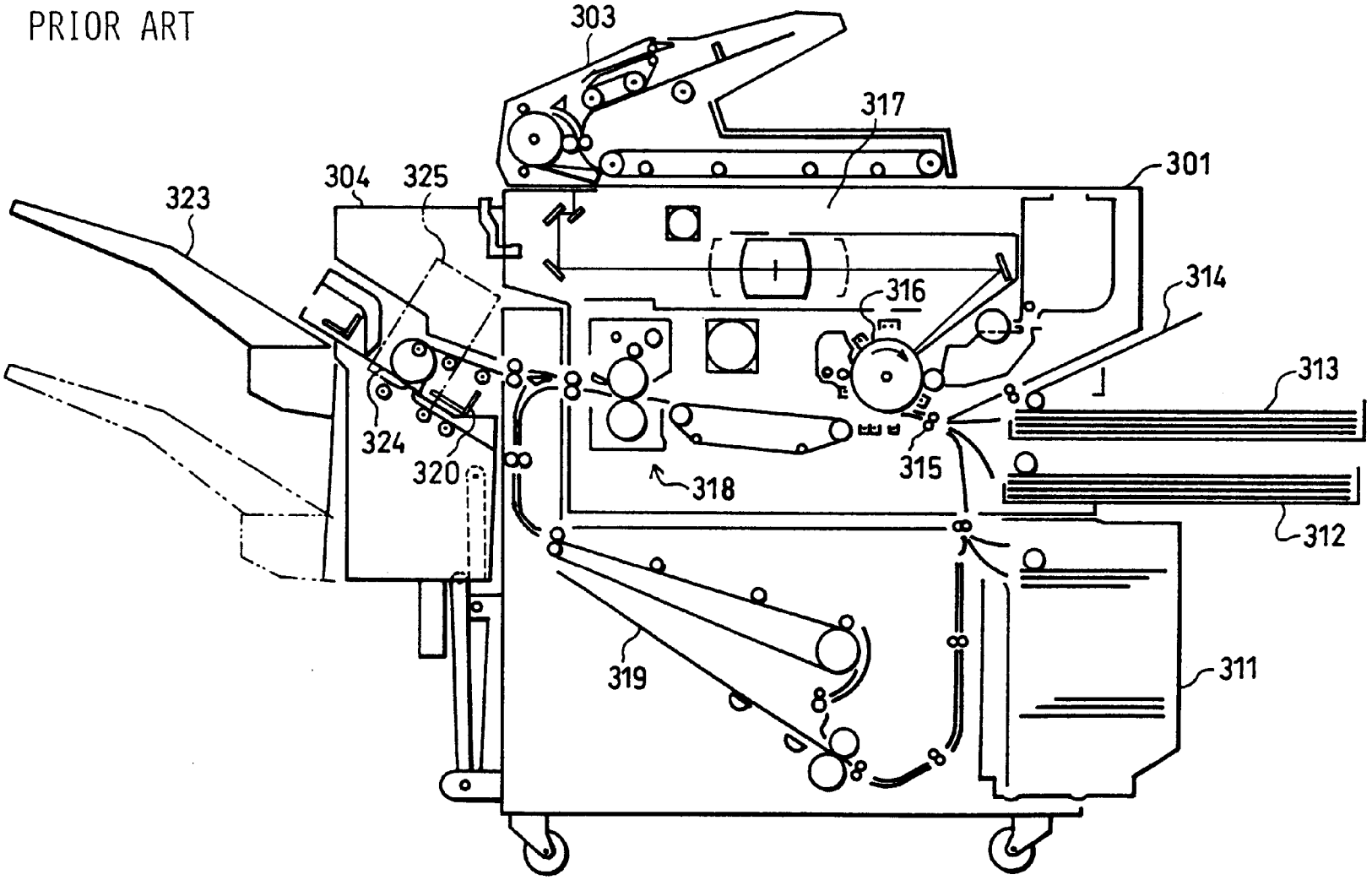
FIG.6 PRIOR ART
FIG. 6 is a schematic structural diagram of a conventional image-forming device with a sheet postprocessing device.
Figure 7:
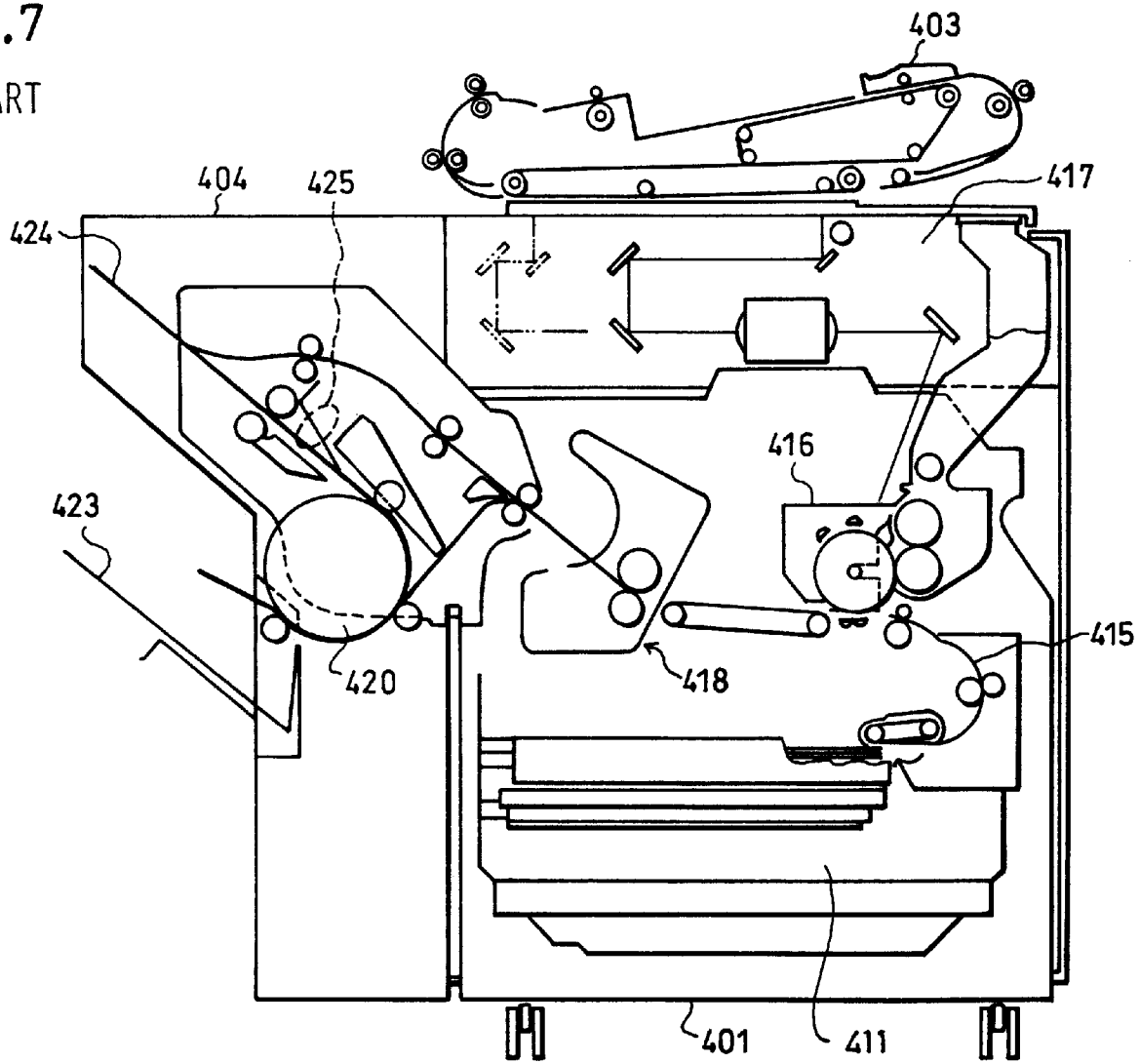
FIG.7 PRIOR ART
FIG. 7 is a schematic structural diagram of another conventional image-forming device with a sheet postprocessing device.
Figure 8:
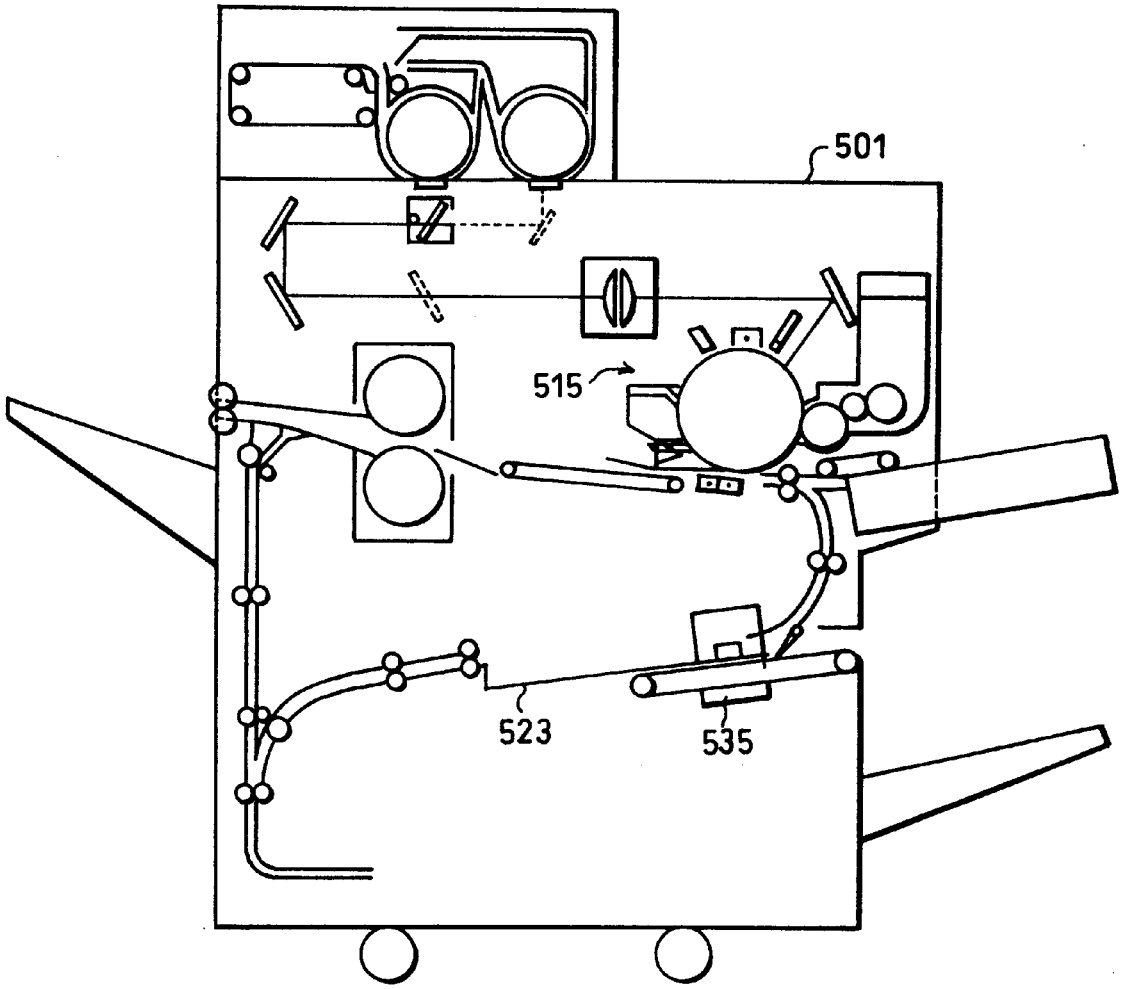
FIG.8 PRIOR ART
FIG. 8 is a schematic structural diagram of a further conventional image-forming device with a sheet postprocessing device.

As shown in FIG. 5, this discharge means is composed of a postprocessing tray 202 which inclines downward toward one end, a pair of postprocessing tray transport rollers 201*a* and 201*b* which transport sheets into the postprocessing tray 202, an upper sheet guide 203 which guides the sheets transported by the postprocessing tray transport rollers 201*a* and 201*b* into the postprocessing tray 202, a stopper 204 which prevents the sheets stacked in the postprocessing tray 202 from sliding downward, and a discharge tray 205 which receives the postprocessed stack of sheets sliding out of the postprocessing tray 202.

Since, as mentioned above, the postprocessing tray 202 inclines downward toward one end, the sheets transported from the postprocessing tray transport rollers 201*a* and 201*b* will fall against the stopper 204 by their own weight. In other words, they will be aligned by their own weight. At this time, the stopper 204 is in its alignment position 204*a*. The aligned sheets are then stapled by a stapler 206 provided toward the lower end of the postprocessing tray 202. The stopper 204 is then withdrawn to its withdrawn position 204*b*, and the stack of sheets 210 slides into the discharge tray 205 by its own weight.

In a discharge means with the above structure, since the stapled stack 210 slides into the discharge tray 205 by its own weight, based only on the movement of the stopper 204, there is no need to provide rollers or other components to discharge the stack 210 to the discharge tray 205, and the device as a whole can be streamlined.

Both of the foregoing embodiments explained a combined copy machine combining the functions of a copy machine, a printer, and a facsimile, but the present invention may also be applied to a device without the exposure reading unit 3 and the original feed unit 4, which functions only as a printer or as a facsimile, or to a device which functions only as a copy machine, or to a device combining these functions as needed, or to a word processor, or, in short, to any image-forming device.

Further, the foregoing embodiments explained an image formation unit having a device adopting the Carlson process, in which a laser creates an electrostatic latent image on a photoreceptor, and an image formed on the photoreceptor in dry toner is transferred to a sheet, but the present invention may also be applied to image formation units in which the means for forming images is liquid ink, photosensitive paper, etc.

Again, the foregoing embodiments explained stapling as an example of postprocessing, but the present invention may also be applied to other postprocessing functions such as a stamping function, hole-punch function, and gluing function.

As discussed above, the first image-forming device according to the present invention is provided with an image formation section which forms images on sheets of recording paper; a sheet postprocessing device having a stacking section where sheets with images formed thereon are temporarily stacked, and a postprocessing section which performs postprocessing such as stapling of the sheets stacked in the stacking section; a discharge means which discharges the sheets stacked in the stacking section; and a discharge tray which receives the sheets discharged by the discharge means; wherein the stacking section is provided above the image formation section.

With the above structure, since the stacking section is provided above the image formation section, the postprocessing device which performs postprocessing such as stapling of the sheets stacked in the stacking section is also provided above the image formation section. The stacking section and the sheet postprocessing device as a whole are thus provided within the image-forming device itself, instead of being attached externally to the side of the image-forming device (as was the case with conventional devices), thus allowing the device as a whole to be made more compact.

As discussed above, the structure of the second image-forming device according to the present invention is that of the first image-forming device above, with, additionally, the discharge tray provided at substantially the same height as the stacking section.

Since the above structure provides the discharge tray at substantially the same height as the stacking section, the postprocessed sheets are discharged to a position at which they can be easily removed or checked by the operator. In other words, the sheets are discharged to a position at which the operator can easily view or remove them without bending down.

As a result, postprocessed sheets are not discharged to a position below the operator's normal operating position or one at which they can only be checked with difficulty, as was the case with conventional devices in which a sheet postprocessing device was provided beneath the image formation section or externally attached to the side of the main device. Thus removal and checking of sheets stacked in the discharge tray can be made easier.

As discussed above, the structure of the third image-forming device according to the present invention is that of the first or second image-forming device above, wherein there is also provided a transport means which transports sheets on which images have been formed by the image formation section to the stacking section of the sheet postprocessing device; the transport means transporting the sheets into the stacking section with the image side facing down.

With the above structure, the transport means provided inside the image-forming device transports sheets into the stacking section face down. Thus sheets with images formed thereon corresponding to originals in pages may be stacked in the stacking section in page order beginning with page one. By means of this structure, when the image-forming device is being used as a printer, facsimile, etc., and sheets are stacked in the stacking section in the order of image formation, the sheets are stacked in the correct page order, and can be stapled or otherwise postprocessed.

As discussed above, the structure of the fourth image-forming device according to the present invention is that of the first or second image-forming device above, wherein there are also provided transport means which transport sheets on which images have been formed by the image formation section to the stacking section of the sheet post-processing device, turnover means which turn over sheets on which images have been formed, and resupply means which re-supply the turned-over sheets to the image formation section.

With the above structure, the sheets with images formed thereon are turned over by the turnover means before being stacked in the stacking section, and the turned-over sheets are then re-supplied to the image formation section by the resupply means. Thus the stacking section functions both as a postprocessing tray used in postprocessing and as an intermediate tray used when images are to be formed on both sides of sheets in double-sided copying. Thus the structure is more streamlined than one which provides separate post-processing and intermediate trays, and the device as a whole can be made more compact.

As discussed above, the structure of the fifth image-forming device according to the present invention is that of the fourth image-forming device above, with, additionally, the turnover means being provided in a transport channel which transports sheets from the image formation section to the stacking section.

With the above structure, since the turnover means is provided in the transport channel which guides the sheets from the image formation section to the stacking section, the sheets can be transported into the stacking section with the respective sides with images formed thereon facing up. By this means, when images corresponding to originals in pages are to be formed, images can be formed and sheets stacked beginning with the last page, and thus the sheets will be stacked in the stacking section face up in the correct order.

As discussed above, the structure of the sixth image-forming device according to the present invention is that of the first or second image-forming device above, wherein, further, a transport channel which transports sheets from the image formation section to the stacking section is provided with at least two sheet intake holes which introduce the sheets into the sheet stacking section, with the second sheet intake hole provided in the downstream sheet transport direction from the first sheet intake hole.

With the above structure, if large-sized sheets are introduced through the (upstream) first sheet intake hole, and sheets smaller in size than the sheets introduced through the first sheet intake hole are introduced through the (downstream) second sheet intake hole, sheets in the stacking section can be aligned more easily than if all sheets were introduced into the stacking section through a single sheet intake hole.

Further, if one of the two sheet intake holes is provided with a turnover means for turning over sheets, the sheets can be turned over before being introduced into the stacking section. Moreover, since the turnover means is provided at the sheet intake hole for introducing the sheets from the transport channel into the stacking section, the turnover means is provided above the image formation section. Accordingly, the device as a whole can be made narrower in width than a device in which the turnover means is provided next to the image formation section.

As discussed above, the structure of the seventh image-forming device according to the present invention is that of any of the first through sixth image-forming devices above, wherein there is also provided an elevating means which raises and lowers the discharge tray as needed. In this case, it is preferable if the elevating means raises and lowers the discharge tray according to the amount of discharged sheets stacked therein.

In the above structure, if the elevating means raises and lowers the discharge tray according to the amount of discharged sheets therein, so as, for example, to maintain the surface of the top sheet in the discharge tray at a constant height, stable discharge of sheets can be maintained, and the discharged sheets may also be easily viewed.

As discussed above, the eighth image-forming device according to the present invention has the structure according to any of the first through seventh image-forming devices above, on the exterior of which, in addition to the discharge tray, a sheet supply means is provided for allowing supply of sheets to the image formation section; wherein the sheet supply means is provided beneath the discharge tray.

With the above structure, since the sheet supply means is provided beneath the discharge tray, both the sheet supply means and the discharge tray are provided on the same side of the image-forming device. As a result, the width of the device as a whole can be reduced. Moreover, since the sheet supply means is provided beneath the discharge tray, operability of the device with respect to viewing and removal of the sheets stacked in the discharge tray can be improved.

As discussed above, the structure of the ninth image-forming device according to the present invention is that of any of the first through eighth image-forming devices above, wherein, additionally, the stacking section is provided with an alignment/discharge member, which pushes on the rear end of the sheets stacked in the stacking section, thus aligning the sheets toward the discharge tray, and which discharges the stacked sheets to the discharge tray.

In the above structure, the alignment/discharge member serves both as an alignment member, which aligns the sheets stacked in the stacking section, and as a discharge member, which discharges the sheets stacked in the stacking section toward the discharge tray. Accordingly, the structure of the device as a whole can be streamlined, it can be made more compact, and manufacturing costs can be reduced.

As discussed above, the tenth image-forming device according to the present invention is provided with a reading section which reads the image information of an original; a digital image formation section which converts the image information read by the reading section into digital image information, and forms images on sheets of recording paper based on that digital image information; a sheet postprocessing device having a stacking section where sheets with images formed thereon are temporarily stacked, and a post-processing section which performs postprocessing such as stapling of the sheets stacked in the stacking section; discharge means which discharge the sheets stacked in the stacking section; and a discharge tray which receives the sheets discharged by the discharge means; wherein the stacking section is provided above the digital image formation section and below the reading section.

In the above structure, since the stacking section is provided above the digital image formation section, the sheet postprocessing section which performs postprocessing such as stapling of the sheets stacked in the stacking section is also provided above the digital image formation section. In other words, the sheet postprocessing device as a whole is provided within the image-forming device. As a result, the device as a whole can be made more compact than a structure in which the postprocessing device is externally attached to the image-forming device.

Moreover, since the image formation section is digital, the scanning light of the reading section is not guided directly to the photoreceptor, but is temporarily stored as digital image data within the device, and then the photoreceptor is exposed by laser light projected in accordance with the image data. As a result, there is no need for an optical system in the upper part of the digital image formation section to guide the scanning light from the reading section to the photoreceptor, and the stacking section of the sheet postprocessing device can be provided above the digital image formation section without undue difficulty.

As discussed above, the structure of the eleventh image-forming device according to the present invention is that of the tenth image-forming device above, with, additionally, the discharge tray provided at substantially the same height as the stacking section.

Since the above structure provides the discharge tray at substantially the same height as the stacking section, the postprocessed sheets are discharged to a position at which they can be easily removed or checked by the operator. In other words, the sheets are discharged to a position at which the operator can easily view or remove them without bending down.

As a result, postprocessed sheets are not discharged to a position below the operator's normal operating position or one at which they can only be checked with difficulty, as was the case with conventional devices in which a sheet postprocessing device was provided beneath the image formation section or externally attached to the side of the main device. Thus removal and checking of sheets stacked in the discharge tray can be made easier.

As discussed above, the structure of the twelfth image-forming device according to the present invention is that of the tenth or eleventh image-forming device above, wherein, further, the reading section is moveable in such a way that the stacking section of the sheet postprocessing device can be exposed.

In the above structure, since the reading section is moveable in such a way that the stacking section of the sheet postprocessing device can be exposed, paper jams and other conditions of the sheet postprocessing device can be easily checked by merely moving the reading section. As a result, it is easier to perform maintenance of the sheet postprocessing device. In particular, maintenance such as refill of the sheet postprocessing device's stapler becomes easy to perform.

Next, a transport structure for discharging sheets of recording paper on which images have been formed by an image formation unit will be explained. By means of this transport structure, an image-forming device can be provided which is capable of high-speed discharge of sheets of recording paper with images formed thereon. The following will explain this image-forming device with reference to FIGS. 9 through 11.

Figure 9:
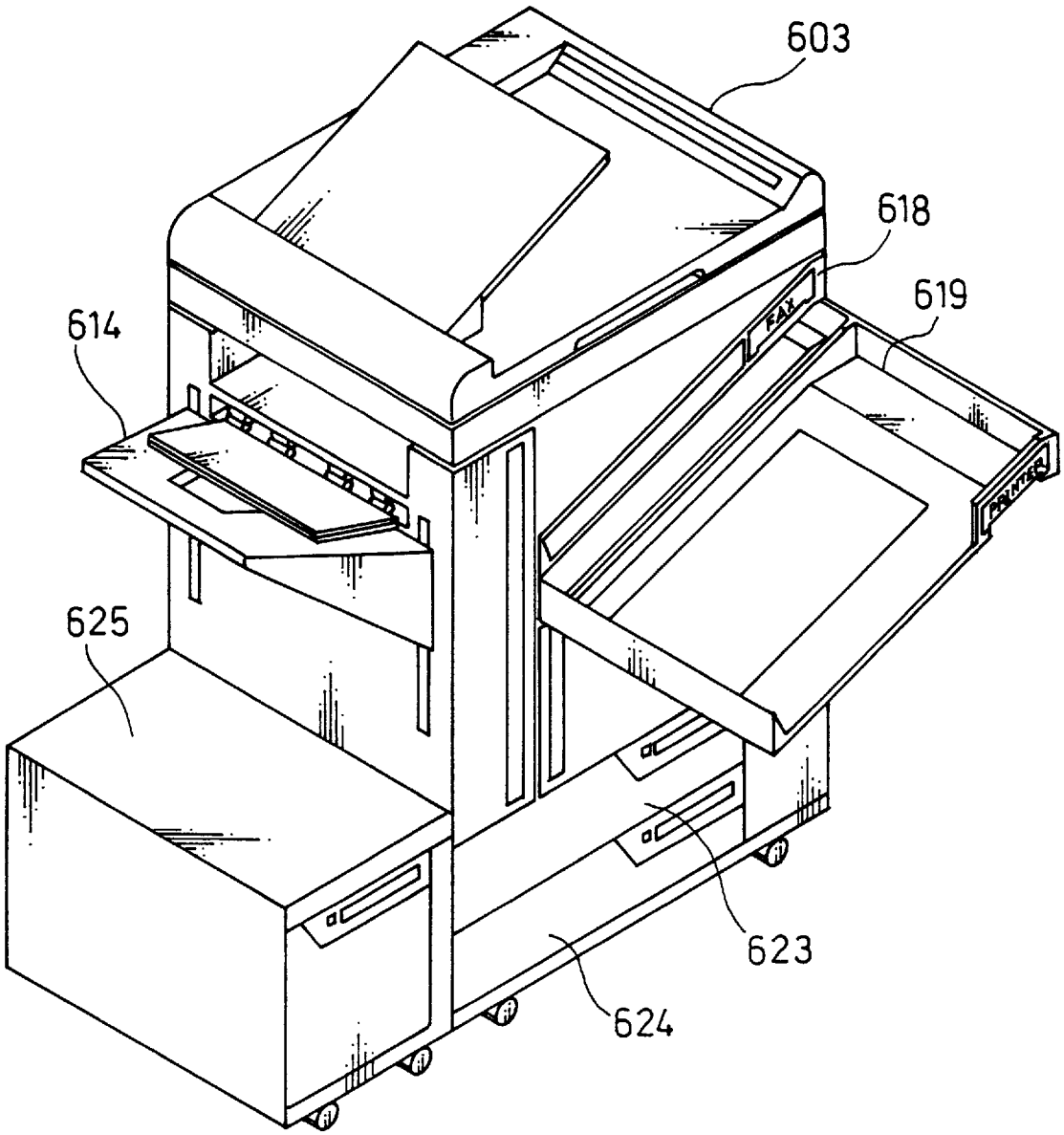
FIG. 9 is a perspective view showing an image-forming device according to a further embodiment of the present invention.
Figure 10:
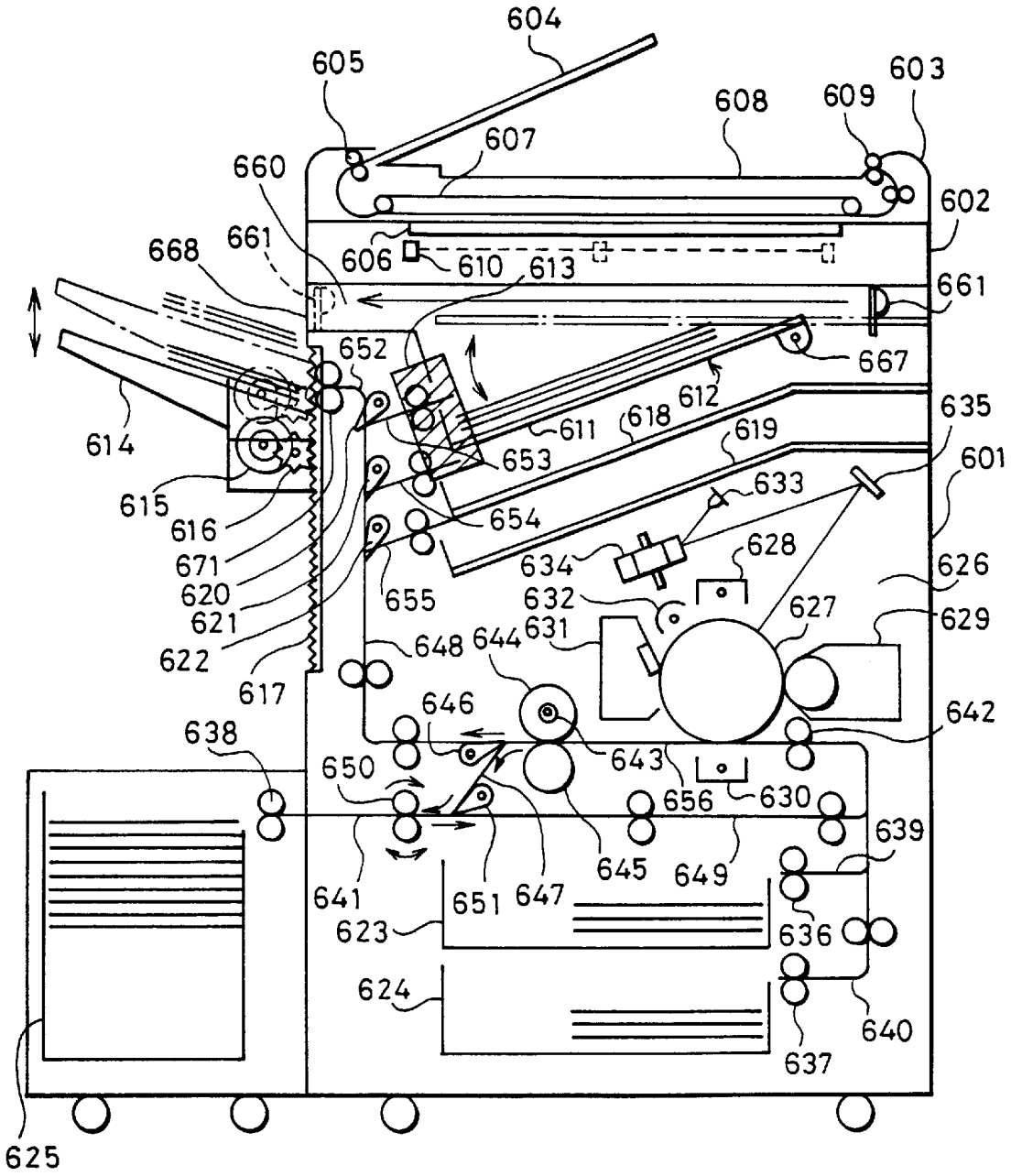
FIG. 10 is a cross-sectional view of the image-forming device shown in FIG. 9.

FIG. 9 is a perspective view showing an embodiment of this image-forming device, and FIG. 10 is a cross-sectional view showing the embodiment shown in FIG. 9.

As shown in FIG. 10, the image-forming device according to the present embodiment is provided with an exposure reading unit 602 on a main body 601, and an original feed unit 603 on the exposure reading unit 602.

The original feed unit 603 comprises an original supply tray 604 where originals are stacked, a pair of original supply rollers 605 which supply originals one sheet at a time from the stack of originals in the original supply tray 604, an original transport belt 607 which transports an original to and positions the original on a glass plate 606 provided in the exposure reading unit 602, an original discharge tray 608 where the originals which have been read are stacked, and original discharge rollers 609 which discharge the originals which have been read to the original discharge tray 608.

The exposure reading unit 602 is provided with the glass plate 606 where the original is positioned, and a CCD sensor 610 which is capable of moving back and forth under the original positioned on the glass plate 606, and reads the image on the original by scanning with the CCD sensor 610 based on an exposure start signal.

Beneath the exposure reading unit 602 is provided a sheet postprocessing unit 611. This sheet postprocessing unit 611 comprises a postprocessing tray 612, which inclines downward toward the side from which sheets of recording paper are introduced, and a stapler 613.

On the left side of the main body 601 shown in FIG. 10 is provided a discharge tray 614, which inclines downward toward the main body 601, and which can be raised or lowered by the forward or reverse operation of a motor 615 provided in the discharge tray 614, the motor 615 being connected to a gear 616 which meshes with a rack 617 provided on the side of the main body 601 facing the discharge tray 614.

Beneath the sheet postprocessing unit 611 are provided a facsimile discharge tray 618 and a printer discharge tray 619, and switching gates 620, 621, and 622, which select, according to various image formation modes which will be discussed below, to which of the discharge trays 614, 618, or 619 sheets are discharged.

In the lower part of the main body 601 are provided paper cassettes 623, 624, and 625, which store recording paper on which images are to be formed.

In the center of the main body 601 is provided an image formation unit 626, which is composed of a photoreceptor 627 and, arranged around the photoreceptor 627, a charging device 628, a developing device 629, a transfer device 630, a cleaning device 631, a static eliminator 632, a laser oscillator element 633, a polygon mirror 634, and a mirror 635.

In the above structure, recording paper from the paper cassettes 623, 624, and 625 is supplied one sheet at a time by supply rollers 636, 637, and 638, respectively, and transported through supply transport channels 639, 640, and 641, respectively, to a pair of resist rollers 642.

At this time, the photoreceptor 627 is given an equal charge throughout by the charging device 628, and laser light is projected from the laser oscillator element 633 to the photoreceptor 627 by way of the polygon mirror 634, revolving at high speed, and the mirror 635, thus exposing the photoreceptor 627 in accordance with an image signal and creating an electrostatic latent image thereon. By supplying toner from the developing device 629, this latent image becomes a toner image.

Next, the resist rollers 642 are driven with a timing which will properly bring together the sheet transported to the resist rollers 642 and the toner image on the photoreceptor 627. Thus the sheet is transported between the transfer device 630 and the photoreceptor 627, and the toner image is transferred onto the sheet.

Excess toner remaining on the surface of the photoreceptor 627 without being transferred to the sheet is removed by the cleaning device 631, and then the surface charge of the photoreceptor 627 is removed by the static eliminator 632.

The sheet onto which the toner image has been transferred passes between a pair of heat rollers, in which an upper heat roller 644 containing a heat lamp 643 puts pressure on and drives a lower heat roller 645, and which fix the toner image on the sheet. This completes formation of an image on the sheet.

A sheet on which an image has been formed is then sent, by a turnover gate 646, either into a turnover transport channel 647, or into a transport channel 648 leading to the sheet postprocessing unit 611, the discharge tray 614, the facsimile discharge tray 618, or the printer discharge tray 619.

The turnover transport channel 647 joins with a transport channel 649 which transports sheets from the paper cassette 625. A sheet transported into the turnover transport channel 647 is temporarily transported toward the paper cassette 625 by a pair of reversible turnover rollers 650. Then a switchback gate 651 is switched, and the turnover rollers 650 reverse their rotation directions while the sheet is held between them, thus switching back the sheet and transporting it into the transport channel 649. Thus the sheet is turned over and transported back to the resist rollers 642.

If a sheet on which images have been formed is sent by the turnover gate 649 into the transport channel 648, then the switching gates 620, 621, and 622 are switched in accordance with the image formation mode in effect, and the sheet is sent to (a) a discharge transport channel 652 (a first transport channel) which transports it to the discharge tray 614, to (b) a postprocessing transport channel 653 (a second transport channel) which transports it to the sheet postprocessing unit 611, to (c) a facsimile discharge transport channel 654 which transports it to the facsimile discharge tray 618, or to (d) a printer discharge transport channel 655 which transports it to the printer discharge tray 619.

The image-forming device with the foregoing structure is able to form images based on image signals from facsimile reception, from a host computer, or from the exposure reading unit 602 provided within the image-forming device itself.

First, when images are to be formed based on image signals from facsimile reception, laser light is controlled in accordance with the image signals and projected by the laser oscillator element 633 onto the photoreceptor 627, thus forming an electrostatic latent image thereon. Then, the image is formed on the upper surface of a sheet as it is transported through a transport channel 656 of the image formation unit 626. Next, the switching gates 621 and 622 are switched so that the sheet with the image formed thereon is transported by the facsimile discharge transport channel 654 to the facsimile discharge tray 618, where it is stacked face-down.

In the same way, when images are to be formed based on image signals from a host computer, the switching gate 622 is switched so that the sheet with the image formed thereon is transported by the printer discharge transport channel 655 to the printer discharge tray 619, where it is stacked face-down.

When forming N pages of images on the basis of image signals from facsimile reception or from a host computer, the image signals are usually sent to the image-forming device beginning with page one and ending with page N, and images are formed on sheets in the same order. Since in the facsimile discharge tray 618 and the printer discharge tray 619 the sheets with images formed thereon are stacked face-down beginning with page one, the sheets are stacked in the correct page order.

The image-forming device with the foregoing structure is also able to perform postprocessing of sheets on which are formed images from facsimile reception or from a host computer. In this case, in the same manner as above, the sheets are transported to and stacked face-down in the postprocessing tray 612, which is a stacking section for stacking a plurality of sheets. A stack of sheets stapled in the correct page order may then be prepared by merely stapling the sheets stacked in the postprocessing tray 612 by means of the stapler 613.

Figure 11:
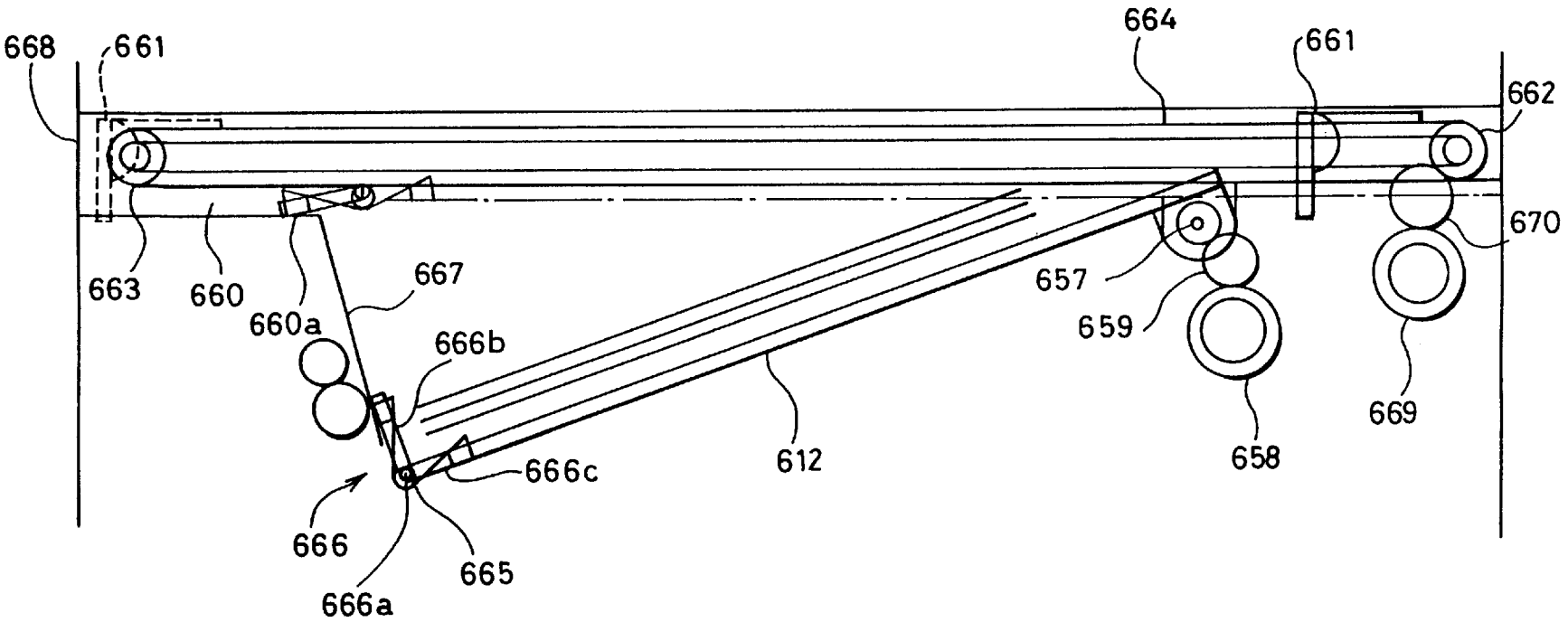
FIG. 11 is an enlarged cross-sectional view of the main part of FIG. 10.
Figure 12:
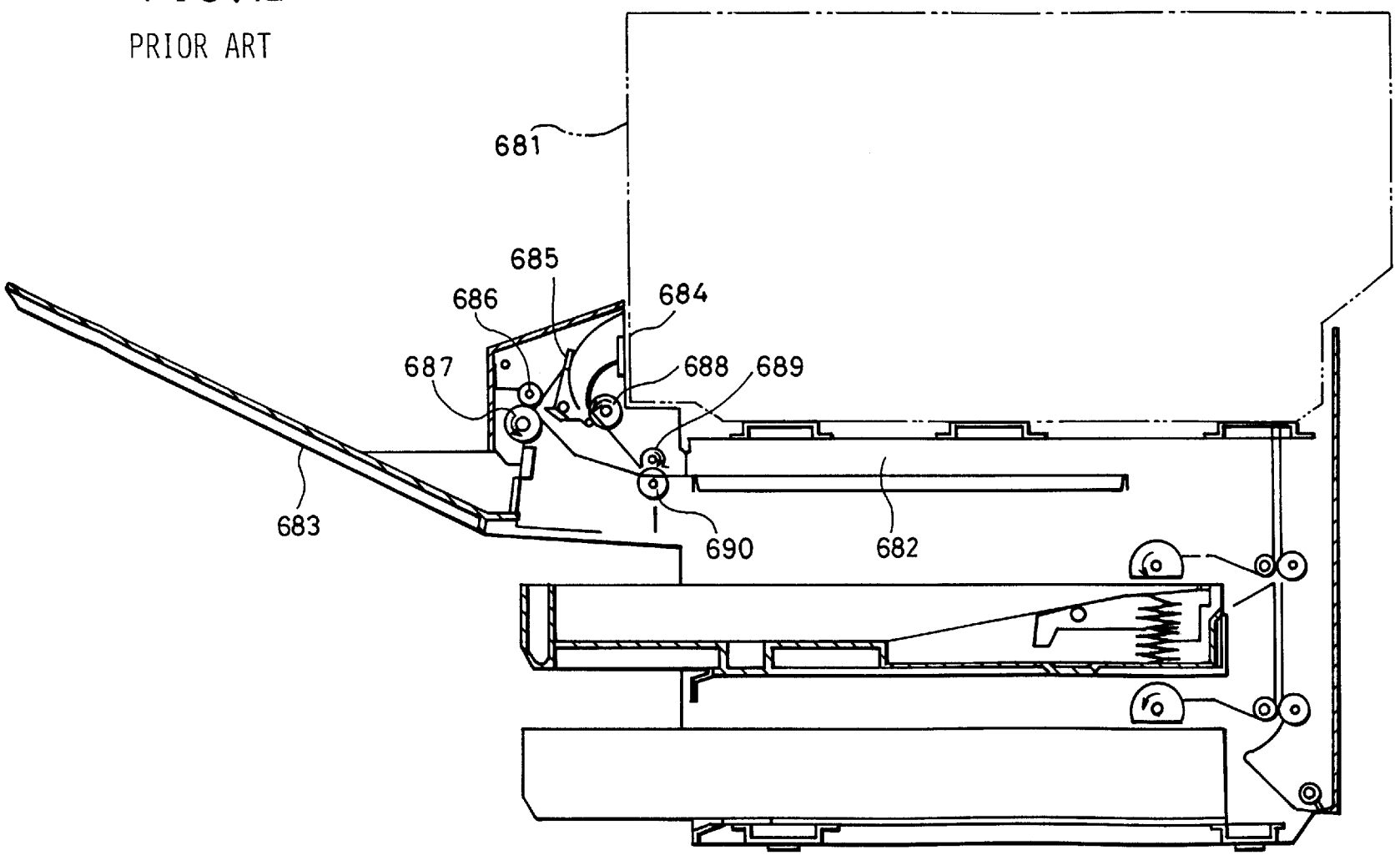
FIG.12 PRIOR ART
FIG. 12 is a schematic cross-sectional view of a conventional image-forming device.

A structure for discharging a stack of postprocessed sheets to the discharge tray 614 will now be explained with reference to FIG. 11. The postprocessing tray 612 is movably supported by a supporting hinge 657 provided at the end of the postprocessing tray 612 opposite the end from which sheets are introduced. Through a gear 659, a tray turning motor 658 turns the postprocessing tray 612 vertically on the axis of the supporting hinge 657 from an inclined position to a horizontal position, and vice versa.

In order to discharge sheets stacked in the postprocessing tray 612 when it is in its horizontal position, a discharge transport channel 660 (a third transport channel), through which the sheets are discharged to the discharge tray 614, and a pusher 661, which pushes the sheets through the discharge transport channel 660 to the discharge tray 614, are also provided. The pusher 661 is affixed to a belt 664 which runs between a driving pulley 662 and a tension pulley 663.

At the end of the postprocessing tray 612 from which sheets are introduced is provided a sheet end guide 666, which is pushed in a counterclockwise (on FIG. 11) direction by a spring 665.

The sheet end guide 666 is made up of a turning component **666*b* and a fixed component 666*c*, connected by a supporting hinge 666*a*. The turning component 666*b* is pushed by the spring 665, and turns on the supporting hinge 666*a* when a force greater than the pushing force is applied. The fixed component 666*c* is attached to the bottom of the end of the postprocessing tray 612 from which sheets are introduced, and does not turn. In other words, when the postprocessing tray 612 is in its horizontal position, the turning component 666*b* does not turn, and the sheet end guide 666 is opened in a substantially horizontal position. When the postprocessing tray 612 is in its inclined position, on the other hand, the turning component 666*b* is pushed against a tray opposing surface 667, and turns upward so as to be substantially perpendicular to the postprocessing tray 612. The tray opposing surface 667 is provided at the end of the discharge transport channel 660 in a position so that the turning component 666*b* of the sheet end guide 666 is turned upward (substantially perpendicular to the postprocessing tray 612) when the postprocessing tray 612** is in its inclined position.

Next, the discharge operations for discharging a stack of sheets to the discharge tray 614 after postprocessing will be explained with reference to FIG. 11. First, the sheets transported into the postprocessing tray 612 when it is in its inclined position fall against the sheet end guide 666 by their own weight, thus aligning their ends.

This is based on the following facts. Namely, as mentioned above, the sheet end guide 666 is provided so as to be moveable, and, since it is pressed against the tray opposing surface 667 by the spring 665, the sheet end guide 666 is turned upward so that the turning component **666*b* is perpendicular to the sheet stacking surface of the sheet postprocessing tray 612, and the ends of the sheets are aligned against the sheet end guide 666**.

Then, after all of the sheets have been stacked in the postprocessing tray 612 and stapled, the tray turning motor 658, through the gear 659, turns the postprocessing tray 612 with its stack of postprocessed sheets vertically on the supporting hinge 657 to the horizontal position indicated on the Figure by dot and dash lines. At this time, the turning component 666*b* turns, by the force of the spring 665, to its open position, so that the sheet end guide 666 is substantially parallel (horizontal) to the sheet stacking surface of the postprocessing tray 612, and the sheet end guide 666 is maintained in contact with the bottom 660*a* of the discharge transport channel 660.

Then the pusher 661 moves toward the left (on the Figure) from the waiting position indicated on the Figure by solid lines. By means of this movement, the pusher 661 pushes the rear end of the stack of sheets to the discharge completed position indicated on the Figure by broken lines. By this means, the stack of sheets which had been stacked in the postprocessing tray 612 is discharged through the discharge hole 668 to the discharge tray 614.

The pusher 661 moves as described above when the postprocessing tray 612 has been turned to the horizontal position indicated on the Figure by dot and dash lines. In concrete terms, when the postprocessing tray 612 has completed its turn to horizontal position, a pusher motor 669 drives, through a gear 670, the driving pulley 662, which drives the belt 664, thus moving the pusher 661 attached thereto.

Next, the image-forming device in the present embodiment is used as a copy machine when images are formed on the basis of image signals from the exposure reading unit 602 incorporated within the image-forming device.

For example, operations for making M sets of copies of an original of N pages, without stapling, are as follows. The original of N pages is placed in the original supply tray 604 of the original feed unit 603, and is transported to the exposure reading unit 602 one page at a time beginning with page N and ending with page one. The original images from page N through page 1 converted into image signals by the exposure reading unit 602 are temporarily stored in a high-capacity memory device (not shown) such as a high-capacity RAM or hard disk.

Next, the image signals beginning with page N and ending with page one are sent by the high-capacity memory device to the laser oscillator element 633, which projects laser light to expose the photoreceptor 627 in accordance with each page of image signals. Each electrostatic latent image thereby formed on the photoreceptor 627 becomes a toner image, which is transferred to a sheet of recording paper. Each sheet onto which an image has been transferred is transported by the discharge transport channel 652 to the discharge rollers 671, which discharge the sheet to the discharge tray 614. Each sheet beginning with page N and ending with page one is thus stacked in the discharge tray 614 with the image side facing up. When one complete set of copies of N pages has been discharged in this way, the image signals from page N through page one are again sent from the high-capacity memory device to the laser oscillator element 633, images corresponding to each page of image signals are transferred to sheets of recording paper, and a second complete set of copies of N pages is stacked on the first set in the discharge tray 614. This is repeated until M complete sets of copies of the originals have been discharged, without stapling, to the discharge tray 614.

Next, operations for making M sets of copies of an original of N pages, and stapling the sets of copies, are as follows. First, as above, original images from an original of N pages placed in the original feed unit 603 are temporarily stored in the high-capacity memory device, beginning with page N and ending with page one. Next, images beginning with page one and ending with page N are formed and transferred to sheets of recording paper, and each sheet onto which an image has been transferred is transported by the postprocessing transport channel 653 to the postprocessing tray 612, where the sheets are stacked beginning with page one and ending with page N, with the image side of each sheet facing down. When one complete set of copies of N pages has been stacked in this way, the set is stapled by the stapler 613, and the set stapled in the correct page order is pushed by the pusher 661 through the discharge transport channel 660 to the discharge tray 614.

For the second complete set of copies, the image signals from page one through page N are again sent from the high-capacity memory device to the laser oscillator element 633, images corresponding to each page of image signals are transferred to sheets of recording paper, and a second complete set of copies is stacked in the postprocessing tray 612 after the first set has been discharged. The second set is then stapled by the stapler 613, and the second set stapled in the correct page order is pushed by the pusher 661 through the discharge transport channel 660 to the discharge tray 614, where it is stacked on the first set. This is repeated until M sets of postprocessed copies of the originals have been completed.

In the above operations, since there is no need to send the sheets from page one through page N through a switchback, the time necessary for the switchback of each page can be saved when images are to be formed in succession, thus improving image formation operations.

Incidentally, sheets discharged (a) through the discharge transport channel 652 by the discharge rollers 671, and (b) through the discharge transport channel 660 and the discharge hole 668 by the pusher 661, are both discharged to the discharge tray 614.

The discharge rollers 671 are located beneath the discharge hole 668, and each of these discharges sheets from a different height. Therefore, unless the discharge tray 614 positions the surface of the uppermost sheet stacked therein opposite the position from which the sheets are being discharged, the sheets will not be stacked evenly in the discharge tray 614, and the stack may slide and fall apart.

Accordingly, when sheets are to be discharged through the discharge transport channel 652 by the discharge rollers 671, the discharge tray is lowered to a position (shown on the Figure by solid lines) opposite the discharge rollers 671, and when sheets are to be discharged through the discharge transport channel 660 and the discharge hole 668 by the pusher 661, the discharge tray 614 is raised to a position (shown on the Figure by dot and dash lines) opposite the discharge hole 668. Thus it is ensured that the sheets are stacked evenly in the discharge tray 614, regardless of from which position they are discharged.

As a method for correctly elevating the discharge tray 614 to the appropriate discharge position, a commonly-known sensor body (sensor arm) which detects the surface of the uppermost sheet in the discharge tray 614 can be provided at each of the two discharge positions, and the motor 615 which performs elevating operations can be controlled according to the detection result of the sensor arm.

In other words, the motor 615 raises the discharge tray 614 until the sensor arm detects the surface of the uppermost sheet in the discharge tray 614, at which time driving signals to the motor 615 are stopped, thus stopping the motor and positioning the discharge tray 614 opposite the appropriate discharge position.

In this way, the discharge tray 614 receives the discharged sheets at a position opposite the discharge hole 668 or the discharge rollers 671, as appropriate, and since both the discharge hole 668 and the discharge rollers 671 are provided in the upper part of the main body 601, the discharged sheets are maintained at a high position, where they can be easily checked or removed by the operator.

Further, providing the elevating discharge tray 614 in the upper part of the image-forming device means that the discharge tray can be given a sufficient elevating stroke, and accordingly a large number of sheets can be stacked in the discharge tray. Since the discharge tray can hold a large number of sheets, it will not immediately become full and stop operation of the image-forming device, even when forming a large number of images in succession. Thus the operator need not check the amount of sheets in the discharge tray so often, and the operability of the image-forming device can be improved.

As discussed above, the image-forming device according to the present embodiment is provided with (1) an image formation section, which forms images on sheets of recording paper, (2) a stacking section, for stacking sheets on which images have been formed by the image formation unit, (3) a discharge tray, to which sheets on which images have been formed by the image formation section are discharged, (4) a first transport channel, which transports sheets on which images have been formed from the image formation section such that the sheets are stacked therein with the image side facing up or facing down, (5) a second transport channel, which transports sheets on which images have been formed from the image formation section to the discharge tray in such a way that the image side faces down, (6) a switching means, which switches between the first and second transport channels, (7) a third transport channel, which transports sheets from the stacking section to the discharge tray, and (8) discharge means, which, after sheets on which images have been formed have been stacked in the stacking section, discharges the stack of sheets through the third transport channel to the discharge tray.

When sheets are to be turned over before being discharged to the discharge tray, there is no need to turn over each sheet individually at the discharge stage, since the discharge means discharges the entire stack of sheets from the stacking section through the third transport channel to the discharge tray. Thus there is no need to delay a sheet while the previous sheet is sent through a switchback, and the time required for image formation, and in particular the time required for sheet discharge operations, can be reduced, thus improving image forming efficiency.

It is preferable for the discharge means to be composed of a driving member, which moves the stacking section so that it is parallel with the third transport channel, and a pushing member, which pushes the rear end of the stack of sheets stacked in the stacking section.

With this structure, since the pushing member discharges the stack of sheets in the stacking section by pushing on its rear end, the stack can be discharged in an aligned state without disarray.

It is preferable for the stacking section to be provided above the image formation section, and for the discharge tray to be provided on the side of the main body, higher than the image formation section.

With this structure, since both the stacking section and the discharge tray are provided in the upper part of the main body, the sheet capacity of the discharge tray can be greatly increased.

The concrete embodiments and examples of implementation discussed in the foregoing detailed explanations of the present invention serve solely to illustrate the technical details of the present invention, which should not be narrowly interpreted within the limits of such concrete examples, but rather may be applied in many variations without departing from the spirit of the present invention and the scope of the patent claims set forth below.

What is claimed is:

1. An image-forming device comprising:

an image formation section, which forms images on sheets of recording paper;

a postprocessing device including (1) a stacking section, in which is temporarily stacked a plurality of sheets on which images have been formed by said image formation unit, and (2) a postprocessing section, which performs postprocessing of the sheets stacked in said stacking section, said postprocessing device being provided directly above said image formation section;

discharge means, which discharge the sheets stacked in said stacking section; and a discharge tray, which receives the sheets discharged by said discharge means.

2. The image-forming device set forth in claim 1, wherein:

said discharge tray is provided at substantially the same height as that at which said stacking section is provided.

3. The image-forming device set forth in claim 1, wherein:

said postprocessing device includes transport means, which guide to said stacking section a sheet of recording paper on which an image has been formed by said image formation section; and said transport means transport the sheet to said stacking section such that the side of the sheet on which the image has been formed faces down.

4. The image-forming device set forth in claim 2, wherein:

said postprocessing device includes transport means, which guide to said stacking section a sheet of recording paper on which an image has been formed by said image formation section; and said transport means transport the sheet to said stacking section such that the side of the sheet on which the image has been formed faces down.

5. The image-forming device set forth in claim 1, wherein:

said postprocessing device includes transport means, which guide to said stacking section a sheet of recording paper on which an image has been formed by said image formation section;

said image-forming device further comprising:

turnover means, which turn over the sheet with the image formed thereon; and resupply means, which re-supply to said image formation section the sheet which has been turned over by said turnover means.

6. The image-forming device set forth in claim 2, wherein:

said postprocessing device includes transport means, which guide to said stacking section a sheet of recording paper on which an image has been formed by said image formation section;

said image-forming device further comprising:

turnover means, which turn over the sheet with the image formed thereon; and resupply means, which re-supply to said image formation section the sheet which has been turned over by said turnover means.

7. The image-forming device set forth in claim 5, wherein:

said turnover means are provided in said transport means, which transport the sheet from said image formation section to said stacking section.

8. The image-forming device set forth in claim 6, wherein:

said turnover means are provided in said transport means, which transport the sheet from said image formation section to said stacking section.

9. The image-forming device set forth in claim 1, further comprising:

a transport channel, which transports sheets of recording paper from said image formation section to said stacking section;

said transport channel having at least first and second sheet intake holes, which introduce the sheets into said stacking section, said first sheet intake hole being provided farther in the upstream transport direction than said second sheet intake hole.

10. The image-forming device set forth in claim 2, further comprising:

a transport channel, which transports the sheets of recording paper from said image formation section to said stacking section;

said transport channel having at least first and second sheet intake holes, which introduce the sheets into said stacking section, said first sheet intake hole being provided farther in the upstream transport direction than said second sheet intake hole.

11. The image-forming device set forth in claim 9, wherein:

large-sized sheets of recording paper are introduced into said stacking section through said first sheet intake hole, and sheets smaller in size than those introduced through said first sheet intake hole are introduced into said stacking section through said second sheet intake hole.

12. The image-forming device set forth in claim 10, wherein:

large-sized sheets of recording paper are introduced into said stacking section through said first sheet intake hole, and sheets smaller in size than those introduced through said first sheet intake hole are introduced into said stacking section through said second sheet intake hole.

13. The image-forming device set forth in claim 9, wherein:

either of said first or second sheet intake holes includes turnover means, which turn over the sheet of recording paper.

14. The image-forming device set forth in claim 10, wherein:

either of said first or second sheet intake holes includes turnover means, which turn over the sheet of recording paper.

15. The image-forming device set forth in claim 1, further comprising:

elevating means, which raise and lower said discharge tray.

16. The image-forming device set forth in claim 2, further comprising:

elevating means, which raise and lower said discharge tray.

17. The image-forming device set forth in claim 15, wherein:

said elevating means raise and lower said discharge tray in accordance with the amount of discharged recording paper in said discharge tray.

18. The image-forming device set forth in claim 16, wherein:

said elevating means raise and lower said discharge tray in accordance with the amount of discharged recording paper in said discharge tray.

19. The image-forming device set forth in claim 17, wherein:

said elevating means include a stepping motor and an elevating gear driven by said stepping motor;

said image-forming device further comprising:

a rack, which meshes with said elevating gear, provided in the elevating direction on a side of a main body of said image-forming device.

20. The image-forming device set forth in claim 18, wherein:

said elevating means include a stepping motor and an elevating gear driven by said stepping motor;

said image-forming device further comprising:

a rack, which meshes with said elevating gear, provided in the elevating direction on a side of a main body of said image-forming device.

21. The image-forming device set forth in claim 1, further comprising:

sheet supply means, which supply sheets of recording paper to said image formation section;

said sheet supply means and said discharge tray being provided outside a main body of said image-forming device; and said sheet supply means being provided beneath said discharge tray.

22. The image-forming device set forth in claim 2, further comprising:

sheet supply means, which supply sheets of recording paper to said image formation section;

said sheet supply means and said discharge tray being provided outside a main body of said image-forming device; and said sheet supply means being provided beneath said discharge tray.

23. The image-forming device set forth in claim 1, wherein:

said stacking section includes an alignment and discharge member, which is in contact with the rear end of the sheets stacked in said stacking section, and which aligns the sheets and discharges the sheets toward said discharge tray.

24. The image-forming device set forth in claim 2, wherein:

said stacking section includes an alignment and discharge member, which is in contact with the rear end of the sheets stacked in said stacking section, and which aligns the sheets and discharges the sheets toward said discharge tray.

25. An image-forming device comprising:

a reading section, which reads image information from an original;

a digital image formation section, which converts the image information into digital image data and forms images on sheets of recording paper in accordance with the digital image data;

a postprocessing device made up of a stacking section, in which is temporarily stacked a plurality of sheets on which images have been formed by said image formation section, and a postprocessing section, which performs postprocessing of the sheets stacked in said stacking section, said postprocessing device being provided above said digital image formation section and below said reading section;

discharge means, which discharge the sheets stacked in said stacking section; and a discharge tray, which receives the sheets discharged by said discharge means.

26. The image-forming device set forth in claim 25, wherein:

said discharge tray is provided at substantially the same height as that at which said stacking section is provided.

27. The image-forming device set forth in claim 25, wherein:

said reading section is provided so as to be moveable such that said postprocessing device may be exposed.

28. The image-forming device set forth in claim 27, wherein:

said reading section is provided so as to open upward on a supporting hinge provided on a side of said reading section opposite a side at which operations are carried out.

29. The image-forming device set forth in claim 27, wherein:

said reading section is provided so as to slide on said digital image formation section.

30. An image-forming device comprising:

an image formation section, which forms images on sheets of recording paper;

a stacking section, in which are temporarily stacked a plurality of sheets on which images have been formed by said image formation section;

a discharge tray, to which are discharged the sheets on which images have been formed by said image formation section;

a first transport channel, which transports the sheets on which the images have been formed from said image formation section to said stacking section, such that the sheets are stacked therein with the sides on which the images have been formed facing up or facing down;

a second transport channel, which transports the sheets on which the images have been formed from said image formation section to said discharge tray, such that the sheets are stacked therein with the sides on which the images have been formed facing down;

switching means, which switch between said first and second transport channels;

a third transport channel, which transports the sheets from said stacking section to said discharge tray; and discharge means, which, after the sheets on which the images have been formed have been stacked in said stacking section, discharge the entire stack of the sheets through said third transport channel to said discharge tray.

31. The image-forming device set forth in claim 30, wherein:

said discharge means include a driving member, which moves said stacking section so as to be parallel with said third transport channel, and a pushing member, which pushes the stack of sheets stacked in said stacking section by pushing the rear end of the stack of sheets.

32. The image-forming device set forth in claim 30, wherein:

said stacking section is provided above said image formation section, and said discharge tray is provided on a side of a main body of said image-forming device higher than said image formation section.

33. An image-forming device comprising:

an image formation section, which forms images on sheets of recording paper;

a stacking section, in which are temporarily stacked a plurality of sheets on which images have been formed by said image formation section;

a discharge tray, to which are discharged the sheets on which images have been formed by said image formation section;

a first transport channel, which transports the sheets on which images have been formed from said image formation section to said stacking section, such that the sheets are stacked therein with a side on which the images have been formed facing up or facing down;

a second transport channel, which transports the sheets on which images have been formed from said image formation section to said discharge tray, such that the sheets are stacked therein with the side on which the images have been formed facing down;

switching means, which switch between said first and second transport channels;

a third transport channel, differing from said first and second transport channels, which transports the sheets from said stacking section to said discharge tray; and discharge means, which, after sheets on which images have been formed have been stacked in said stacking section, discharge the entire stack of the sheets through said third transport channel to said discharge tray.

34. The image-forming device set forth in claim 33, wherein:

one end of said stacking section moves freely, such that when the sheets of recording paper are introduced therein from said first transport channel, said stacking section inclines downward toward the end of said stacking section from which the sheets are introduced, and when the sheets are discharged therefrom to said discharge tray, said stacking section meets with said third transport channel.

35. The image-forming device set forth in claim 34, wherein:

said discharge means include a pushing member, which pushes the rear end of the stack of sheets; and the stack of sheets is pushed through said third transport channel and discharged to said discharge tray by said pushing member.

36. The image-forming device set forth in claim 35, wherein:

said pushing member is affixed to a belt running between a driving pulley and a tension pulley, and moves between a withdrawn position and a discharge completed position in accordance with the movement of said belt.

37. The image-forming device set forth in claim 34, wherein:

said stacking section includes a guide member provided on the end of said stacking section from which the sheets are introduced; and said guide member is provided so as to align respective ends of the sheets introduced into said stacking section when said stacking section is in the inclined position, and to guide the stack of sheets into said third transport channel when said stacking section meets with said third transport channel.

38. The image-forming device set forth in claim 37, wherein:

said guide member is provided with a spring, so that:

when said stacking section is in the inclined position, said guide member is turned upward against the force of said spring so as to be substantially perpendicular to the bottom of said stacking section, and, when said stacking section meets with said third transport channel, said guide member opens by the force of said spring so as to be substantially horizontal.

39. The image-forming device set forth in claim 33, wherein:

said discharge tray is provided so as to elevate in accordance with the height of the surface of the uppermost sheet stacked therein.

40. The image-forming device set forth in claim 33, wherein:

said stacking section is provided above said image formation section, and said discharge tray is provided on a side of a main body of said image-forming device higher than said image formation section.

41. The image-forming device set forth in claim 1, wherein said discharge means include:

a postprocessing tray, which inclines downward toward one end;

a guide, which guides sheets of recording paper into said postprocessing tray; and a stopper, provided so as to be moveable between a withdrawn position and an aligning position, which, when in the aligning position, prevents the sheets in said postprocessing tray from sliding downward, and when in the withdrawn position, allows postprocessed sheets to slide by their own weight into said discharge tray.

42. The image-forming device set forth in claim 30, wherein said discharge means include:

a postprocessing tray, which inclines downward toward one end;

a guide, which guides sheets of recording paper into said postprocessing tray; and a stopper, provided so as to be moveable between a withdrawn position and an aligning position, which, when in the aligning position, prevents the sheets in said postprocessing tray from sliding downward, and when in the withdrawn position, allows postprocessed sheets to slide by their own weight into said discharge tray.

43. The image-forming device set forth in claim 33, wherein said discharge means include:

a postprocessing tray, which inclines downward toward one end;

a guide, which guides sheets of recording paper into said postprocessing tray; and a stopper, provided so as to be moveable between a withdrawn position and an aligning position, which, when in the aligning position, prevents the sheets in said postprocessing tray from sliding downward, and when in the withdrawn position, allows postprocessed sheets to slide by their own weight into said discharge tray.

* * * * *